US012714206B2

(12) United States Patent
Kuntz et al.

(10) Patent No.: US 12,714,206 B2
(45) **Date of Patent: *Aug. 25, 2026**

(54) SOLE STRUCTURES AND ARTICLES OF FOOTWEAR HAVING SEPARATE OUTSOLE AND MIDSOLE COMPONENTS

(71) Applicant: NIKE, Inc., Beaverton, OR (US)

(72) Inventors: Keith T. Kuntz, Portland, OR (US); Laura C. Marshala, Portland, OR (US); Courtney M. Wright, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/228,813

(22) Filed: Aug. 1, 2023

(65) Prior Publication Data

US 2024/0041164 A1 Feb. 8, 2024

Related U.S. Application Data

(60) Provisional application No. 63/395,557, filed on Aug. 5, 2022.

(51) Int. Cl.
*A43C 15/16* (2006.01)

(52) U.S. Cl.
CPC ..... *A43C 15/161* (2013.01)

(58) Field of Classification Search
CPC ..... A43B 13/36; A43B 3/224; A43B 13/26; A43B 13/24; A43B 13/28; A43B 3/246; A43C 15/161; A41B 11/00
See application file for complete search history.

(56) References Cited

U.S. PATENT DOCUMENTS 3,878,626 A 4/1975 Isman
3,890,725 A 6/1975 Lea et al.
(Continued)

FOREIGN PATENT DOCUMENTS

AU 2015303831 A1 3/2017
EP 2792261 A1 10/2014
(Continued)

OTHER PUBLICATIONS

Jul. 3, 2023 (WO) International Search Report and Written Opinion—App PCT/US2023/064850, 13 pages.
(Continued)

*Primary Examiner* — Grady Alexander Nunnery

(57) ABSTRACT

Articles of footwear in accordance with some aspects include a simple construction with each component made from a single material and fit together in a releasable manner. At least one specific aspect relates to footwear structure that may include three main parts: (a) an outer cage; (b) an inner upper component; and (c) a chassis and heel counter component with a bottom surface thereof that includes one or more traction element inserts and supports that fit inside one or more traction element outer shells. Another more specific aspect relates to footwear structure that may include two main parts: (a) a foot support component having a plurality of sole locking inserts; and (b) a sole structure component having a plurality of sole cavities, wherein each of the plurality of sole locking inserts fit inside a corresponding each of the plurality sole cavities.

10 Claims, 29 Drawing Sheets

(56) References Cited

U.S. PATENT DOCUMENTS

| | | | | |
|---|---|---|---|---|
| 4,420,894 | A | 12/1983 | Glassman | |
| 5,317,822 | A | 6/1994 | Johnson | |
| 5,319,807 | A * | 6/1994 | Brier | D04B 1/04 66/196 |
| 6,023,859 | A | 2/2000 | Burke et al. | |
| 6,092,305 | A | 7/2000 | Troy et al. | |
| 6,092,311 | A | 7/2000 | MacNamara | |
| 6,701,643 | B2 | 3/2004 | Geer et al. | |
| 7,047,674 | B1 * | 5/2006 | Garvie | A43C 15/162 36/59 A |
| 7,347,011 | B2 * | 3/2008 | Dua | D04B 21/20 36/3 A |
| 7,451,557 | B2 | 11/2008 | McDonald et al. | |
| 7,730,636 | B2 | 6/2010 | Auger | |
| 8,205,357 | B2 | 6/2012 | Keating et al. | |
| 8,429,835 | B2 * | 4/2013 | Dojan | A43B 23/026 36/3 R |
| 9,414,641 | B2 | 8/2016 | Ellis | |
| 9,486,036 | B1 | 11/2016 | Douglas | |
| 9,955,748 | B2 | 5/2018 | Grove et al. | |
| 10,219,583 | B2 | 3/2019 | Dallas | |
| 10,750,813 | B2 | 8/2020 | Hayes et al. | |
| 11,064,759 | B2 | 7/2021 | Olsson et al. | |
| 2005/0188562 | A1 | 9/2005 | Clarke et al. | |
| 2006/0021255 | A1 | 2/2006 | Auger et al. | |
| 2008/0168681 | A1 | 7/2008 | Andersen et al. | |
| 2009/0293315 | A1 * | 12/2009 | Auger | A43B 5/02 36/114 |
| 2011/0010964 | A1 | 1/2011 | Hardy et al. | |
| 2012/0296854 | A1 | 11/2012 | Klein | |
| 2013/0104423 | A1 * | 5/2013 | Hatfield | A43B 23/0235 36/103 |
| 2016/0206042 | A1 | 7/2016 | Cross et al. | |
| 2016/0206046 | A1 | 7/2016 | Cross | |
| 2016/0242506 | A1 | 8/2016 | Kim | |
| 2019/0328082 | A1 | 10/2019 | Del Biondi et al. | |
| 2020/0170335 | A1 | 6/2020 | Horvath et al. | |
| 2020/0268103 | A1 | 8/2020 | Levy et al. | |
| 2020/0375312 | A1 | 12/2020 | Jensen et al. | |

FOREIGN PATENT DOCUMENTS

| | | | | |
|---|---|---|---|---|
| EP | 3076819 | B1 * | 4/2019 | A43B 1/0072 |
| WO | 2011080779 | A1 | 7/2011 | |
| WO | 2011140584 | A1 | 11/2011 | |
| WO | 2013038034 | A1 | 3/2013 | |
| WO | 2015053882 | A1 | 4/2015 | |
| WO | 2018091530 | A2 | 5/2018 | |
| WO | 2019081190 | A1 | 5/2019 | |
| WO | 2020079714 | A1 | 4/2020 | |

OTHER PUBLICATIONS

Lorenzo Salamone, "Are modular sneakers the future of footwear?", NSS MAgazine, nssmag.com, Nov. 19, 2020.

Muvez, "Muvez 3:AM's the Future of House Slippers," Kickstarter, kickstarter.com, Sep. 19, 2020, https://web.archive.org/web/20200919072627/https://www.kickstarter.com/projects/607117669/3-ams-your-house-slipper-reimagined.

Dec. 11, 2023 (WO)—International Search Report and Written Opinion—App PCT/US2023/029177, 16 pages.

Nov. 10, 2025 (EP) Communication and Search Report, App 25203256.0, 7 pages.

* cited by examiner

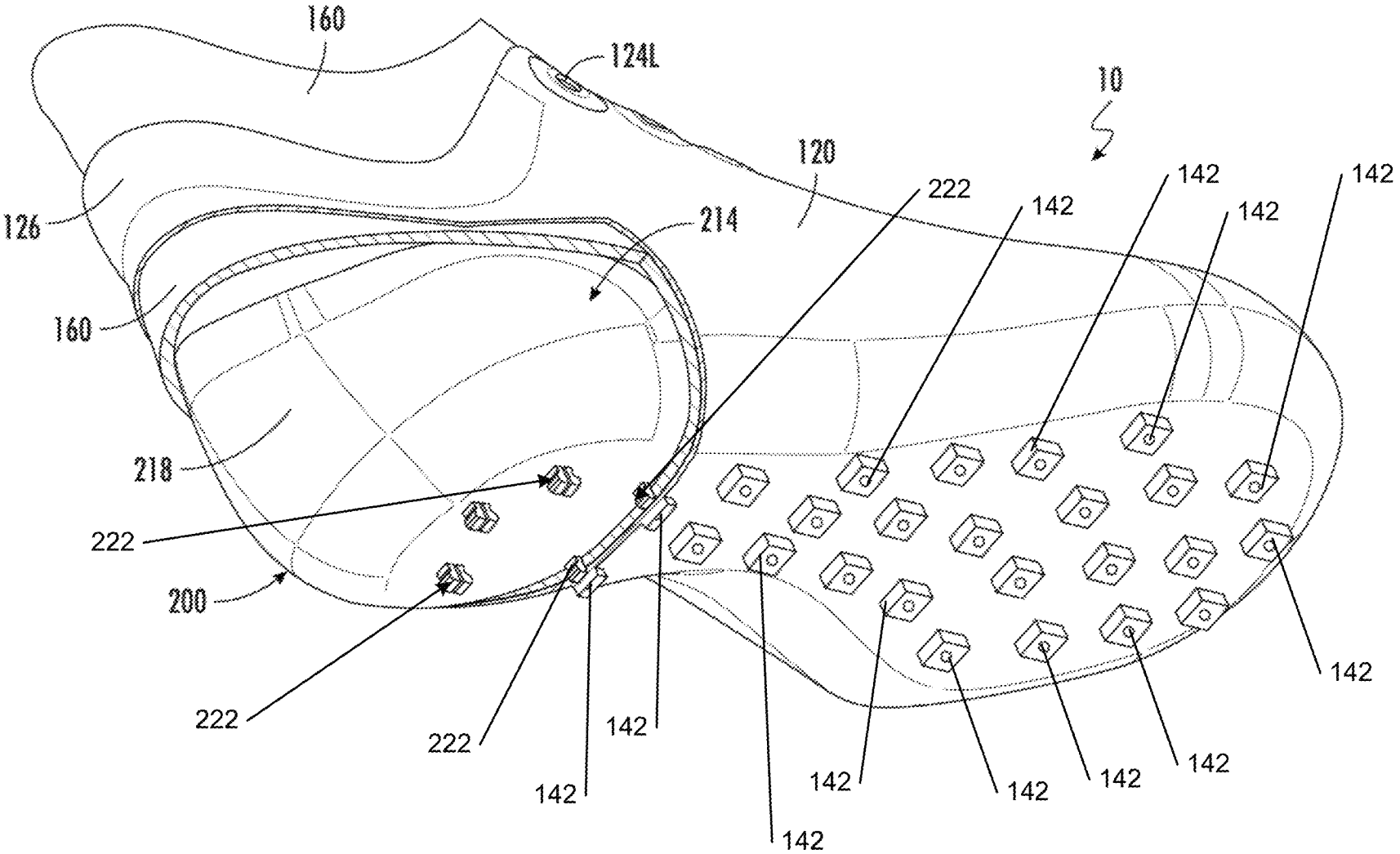
10
120
124L
126
160
160
142
142
142

SOLE STRUCTURES AND ARTICLES OF FOOTWEAR HAVING SEPARATE OUTSOLE AND MIDSOLE COMPONENTS

CROSS-REFERENCE TO RELATED APPLICATIONS

This application is claims priority to U.S. Provisional Patent Application No. 63/395,557, filed Aug. 5, 2022, entitled Sole Structures and Articles of Footwear Having Separate Outsole and Midsole Components, which is incorporated herein by reference in its entirety and made a part hereof.

FIELD OF THE INVENTION

The present invention relates to the field of footwear. More specifically, aspects of the present invention pertain to traction elements, footwear sole structures including such traction elements, and articles of footwear (e.g., athletic footwear) that include such traction elements and sole structures having separate outsole and midsole components. Additional aspects of this invention relate to methods of making footwear sole structures and/or articles of footwear including these traction elements, having separate outsole and midsole components.

BACKGROUND

Cleated footwear provides enhanced traction for athletes in various activities, such as baseball, softball, football, soccer, golf, etc. The cleats provided on such footwear may have different sizes, shapes, orientations, and arrangements on the footwear sole structure, e.g., for use in different activities and/or under different field conditions.

SUMMARY

The present invention generally provides articles of footwear in accordance with some aspects of this technology that include a simple construction that includes three main parts, with each made from a single material and fit together in a releasable manner. Aspects of this technology may enhance the recyclability and sustainable nature of the article of footwear and its component parts.

According to one embodiment, a footwear structure may comprise: an outer cage component formed as a unitary, one-piece construction and a foot support component formed as a unitary, one-piece construction. The outer cage component may include: (i) an outsole portion including a plurality of traction elements, and (ii) an upper portion. The outer cage component may define an interior chamber, wherein the interior chamber includes a footbed portion formed by an interior surface of the outsole portion. The footbed portion may include a plurality of recesses, wherein each of the plurality of recesses may extend into an interior of each of the plurality of traction elements and may define an undercut within the interior of each of the plurality of traction elements. The foot support component may include: (i) a top surface for supporting an entire plantar surface of a wearer's foot and (ii) a bottom surface opposite the top surface. The bottom surface may include a plurality of traction element inserts. Each of the plurality of traction element inserts may extend into a respective one of the plurality of recesses. Each of the plurality of traction element inserts may include an enlarged free end positioned to engage a respective undercut and secure each of the plurality of traction element inserts within a respective one of the plurality of recesses. Additionally, the footwear structure may comprise an inner upper component formed as a unitary, one-piece construction. The inner upper component may define a foot-receiving chamber including a bottom surface, a heel-containing region, a midfoot-containing region, and a forefoot-containing region. The inner upper component may be formed of a fabric material. The bottom surface may include a plurality of openings, wherein each of the plurality of openings is at least partially aligned with a respective one of the plurality of recesses.

According to another embodiment, a footwear structure may comprise a foot support component formed as a unitary, one-piece construction and a sole structure component formed as a unitary, one-piece construction. The foot support component may include: (i) an upper portion that defines an interior chamber, and (ii) a strobel structure attached to the upper portion that includes a top surface for supporting an entire plantar surface of a wearer's foot and a bottom surface opposite the top surface. The interior chamber may include a footbed portion formed by an interior surface of the upper portion. The bottom surface may include a plurality of sole locking inserts. The sole structure component may include: (i) an outsole component that includes a ground-contacting surface for directly engaging the ground, and (ii) a midsole component located between the outsole component and the strobel structure. The midsole component may include a midsole surface including a plurality of sole cavities. Each of the plurality of sole cavities may include a recess extending into an interior of the sole cavity and may define an undercut within the interior of each of the plurality of sole cavities. Each of the plurality of sole locking inserts may extend into a respective one of the plurality of recesses. Each of the plurality of sole locking inserts may include an enlarged free end positioned to engage a respective undercut and secure each of the plurality of sole locking inserts within a respective one of the plurality of recesses.

Other features and advantages of the invention will be apparent from the following specification taken in conjunction with the following drawings.

BRIEF DESCRIPTION OF THE DRAWINGS

The following Detailed Description will be better understood when considered in conjunction with the accompanying drawings in which like reference numerals refer to the same or similar elements in all of the various views in which that reference number appears.

FIG. 6C provides a rear perspective cutaway view of the article of footwear highlighting the engagement between a traction element insert and a traction element outer shell in accordance with some examples of this technology.

DETAILED DESCRIPTION

Figure 1:
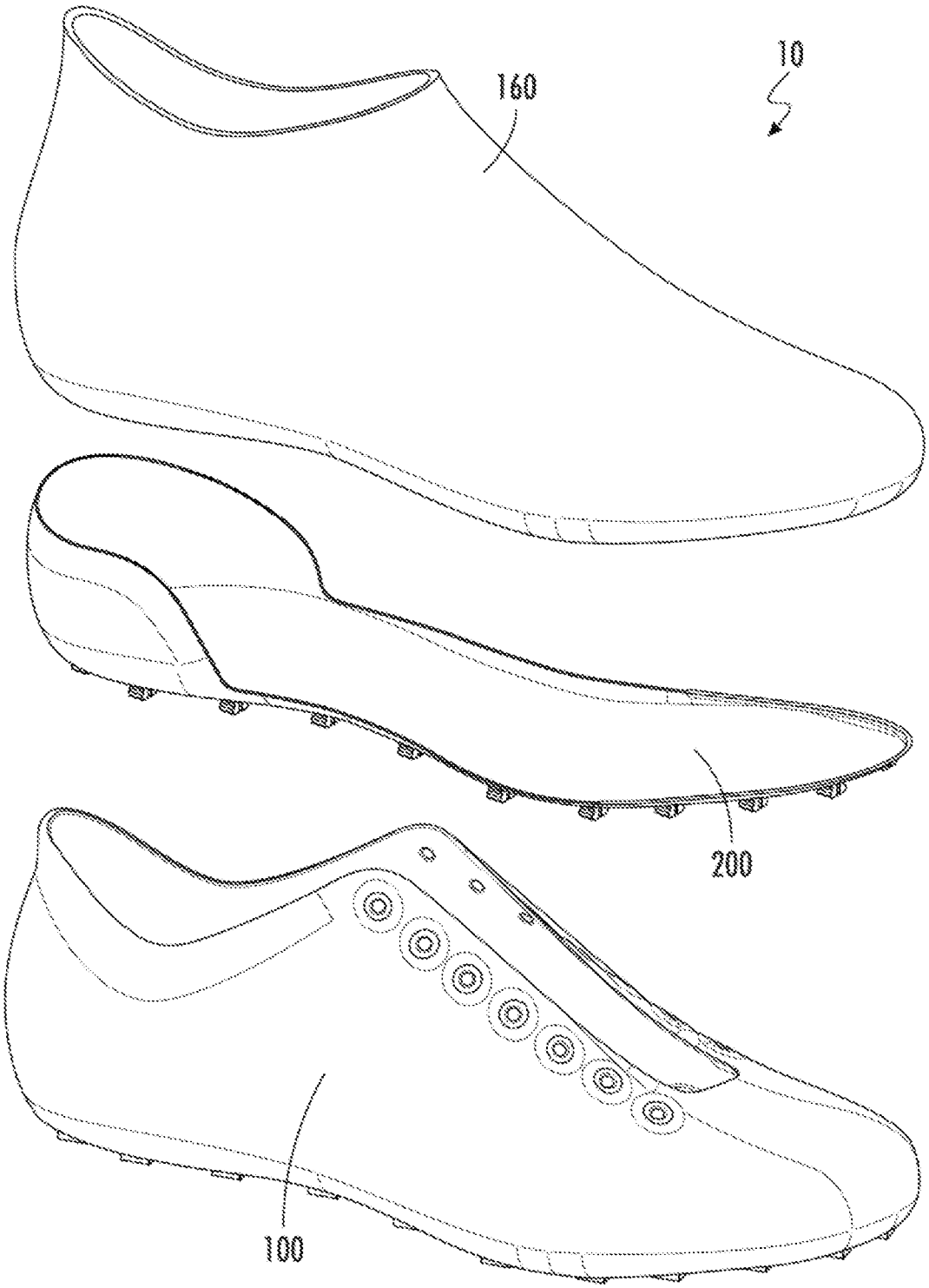
FIG. 1 provides a component view of an article of footwear in accordance with some examples of this technology.

In the following description of various examples of footwear structures and components according to the present technology, reference is made to the accompanying drawings, which form a part hereof, and in which are shown by way of illustration various example structures and environments in which aspects of this technology may be practiced. It is to be understood that other structures and environments may be utilized and that structural and functional modifications may be made to the specifically described structures, functions, and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, running shoes, lifestyle shoes, tennis shoes, baseball cleats, soccer or football cleats, ski boots, basketball shoes, cross training shoes, dance shoes, urban dance shoes, etc.), and the like.

The terms "removably engaged" or "removably attached" as used herein (unless otherwise noted or clear from the context) mean that the two "engaged" or "attached" objects are designed to be repeatedly "engaged/disengaged" and/or "attached/unattached" to one another without damaging either object or structures with which those objects are engaged. In other words, the terms "removably engaged" and/or "removably attached" mean that the two "engaged" or "attached" objects are "non-destructibly removable" and/or releasable from one another.

This application and/or claims use the adjectives, e.g., "first," "second," "third," and the like, to identify certain components and/or features relating to this technology. These adjectives are used merely for convenience, e.g., to assist in maintaining a distinction between components and/or features of a specific structure. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "fourth" in the specification may correspond to any numerical adjective used for that component or feature in the claims).

Various structures and parameters of articles of footwear and sole structures therefor are described based on a "longitudinal length" parameter L. The longitudinal length L can be found with the article of footwear and/or sole structure oriented on a horizontal support surface on its ground-facing surface in an unloaded condition (e.g., with no weight applied to it other than weight of other components of the article of footwear and/or sole structure). Once so oriented, parallel vertical planes that are perpendicular to the horizontal support surface are oriented to contact the rearmost heel location(s) and forwardmost toe location(s) of the article of footwear and/or sole structure. The parallel vertical planes should be oriented facing one another, as far away from one another as possible while still in contact with the rearmost heel and forwardmost toe locations. The direct distance between these vertical planes corresponds to the length (e.g., a longitudinal length) L of the article of footwear and/or sole structure. The locations of some footwear components are described in this specification based on their respective locations along the length as measured forward from the rear heel vertical plane. The rearmost heel location(s) is (are) located at position 0 L and the forwardmost toe location(s) is (are) located at position 1 L along the sole length L. Intermediate locations along the sole length L are referred to by fractional locations (e.g., 0.25 L) along the sole length L measured forward from the rear heel vertical plane. The term "parallel planes" as used herein are planes oriented parallel to the vertical planes. These parallel planes may intersect the longitudinal length or longitudinal direction somewhere between P=0 L and P=1.0 L.

The term "rearward" as used herein means at or toward the heel region of the article of footwear (or component thereof), and the term "forward" as used herein means at or toward a forefoot or forward toe region of the article of footwear (or component thereof). Unless otherwise defined, the terms "heel" or "heel region" refer to a region bounded by parallel planes at 0 L and 0.3 L, the term "midfoot" or "arch" refers to a region bounded by parallel planes at 0.3 L and 0.6 L, and the term "forefoot" refers to a region bounded by parallel planes at 0.6 L and 1.0 L. Also, the term "lateral" means the "little toe" side of an article of footwear or component thereof (e.g., an upper, a sole structure, etc.), and the term "medial" means the "big toe" side of an article of footwear or component thereof (e.g., an upper, a sole structure, etc.).

I. General Description of Aspects of this Technology

Articles of footwear in accordance with some aspects of this technology include a simple construction that includes three main parts, with each made from a single material and fit together in a releasable manner. Aspects of this technology may enhance the recyclability and sustainable nature of the article of footwear and its component parts.

At least some more specific aspects of this technology relate to articles of footwear that may include three main parts: (a) an outer cage, which may include a single piece having features of: (i) a footwear upper and (ii) a sole structure having one or more traction element outer shells; (b) an inner upper component; and (c) a chassis and heel counter component with a bottom surface thereof that includes one or more traction element inserts and supports that fit inside the one or more traction element outer shells.

At least some more specific aspects of this technology relate to articles of footwear that may include two main parts: (a) a footwear upper having a strobel with one or more lock inserts; and (b) a footwear sole component have features of: (i) a midsole with cavities to receive the one or more lock inserts from the strobel and (ii) a outsole component connected to the midsole component with a ground-contacting surface that forms an exterior surface for directly engaging the ground.

Some additional or alternative aspects of this technology relate to an outer cage component formed as a unitary, one-piece construction and a foot support component formed as a unitary, one-piece construction. The outer cage component may include: (i) an outsole portion including a plurality of traction elements, and (ii) an upper portion, wherein the outer cage component defines an interior chamber, wherein the interior chamber includes a footbed portion formed by an interior surface of the outsole portion, the footbed portion including a plurality of recesses. Each of the plurality of recesses may extend into an interior of each of the plurality of traction elements and define an undercut within the interior of each of the plurality of traction elements. The foot support component may include: (i) a top surface for supporting an entire plantar surface of a wearer's foot and (ii) a bottom surface opposite the top surface, wherein the bottom surface includes a plurality of traction element inserts. Each of the plurality of traction element inserts may extend into a respective one of the plurality of recesses. Each of the plurality of traction element inserts may include an enlarged free end positioned to engage a respective undercut and secure each of the plurality of traction element inserts within a respective one of the plurality of recesses.

Still additional or alternative aspects of this technology relate to a foot support component formed as a unitary, one-piece construction and a sole structure component formed as a unitary, one-piece construction. The foot support component may include: (i) an upper portion that defines an interior chamber, wherein the interior chamber includes a footbed portion formed by an interior surface of the upper portion, and (ii) a strobel structure attached to the upper portion that includes a top surface for supporting an entire plantar surface of a wearer's foot and a bottom surface opposite the top surface. The bottom surface may include a plurality of sole locking inserts. The sole structure component may include: (i) an outsole component that includes a ground-contacting surface for directly engaging the ground, and (ii) a midsole component located between the outsole component and the strobel structure, the midsole component including a midsole surface including a plurality of sole cavities. Each of the plurality of sole cavities may include a recess extending into an interior of the sole cavity and define an undercut within the interior of each of the plurality of sole cavities. Each of the plurality of sole locking inserts may extend into a respective one of the plurality of recesses. Each of the plurality of sole locking inserts may include an enlarged free end positioned to engage a respective undercut and secure each of the plurality of sole locking inserts within a respective one of the plurality of recesses.

Alternatively, some aspects of this technology relate to footwear component structures and/or articles of footwear of the types described above in which the components according to any of the examples described above are permanently engaged with one another (e.g., by adhesives or cements, by mechanical fasteners, etc.).

Still additional aspects of this technology relate to methods of making footwear component structures and/or articles of footwear of the various types described above as well as to methods of using footwear component structures and/or articles of footwear of the types described above (e.g., by attaching and detaching the foot support component from the outer cage component, by attaching and detaching the sole structure (or at least a portion thereof) from a footwear upper component, by interchanging different outsole components on a midsole structure, by interchanging different midsole structures on an outsole component, by interchanging different sole structures on an upper component, by interchanging different upper components on a sole structure, by interchanging different foot support components on a sole structure component, by interchanging different sole structure components on a foot support component, by interchanging different upper portions and strobel structures on a sole structure component, by interchanging different sole structure components on an upper portion and strobel structure etc.).

Given the general description of features, examples, aspects, structures, processes, and arrangements according to certain examples of this technology provided above, a more detailed description of specific example footwear component structures, articles of footwear, and/or methods in accordance with this technology follows.

Referring to the figures and following discussion, examples of footwear component structures and articles of footwear in accordance with aspects of this technology are described. The article of footwear 10 of FIG. 1 may be utilized for example, but not limited to lifestyle-type activities, cross-training, yoga, strength workouts, etc. The article of footwear 10 may include an outer cage component 100, an inner upper component 160, and a foot support component 200. Each of the outer cage component 100, inner upper component 160, and foot support component 200 may be formed as a unitary, one-piece construction and/or each made from a single material. The foot support component 200 may fit inside the inner upper component 160 and further the inner upper component 160 and the foot support component 200 together may fit inside the outer cage component 100. Once the foot support component 200 is fit inside the inner upper component 160, these combined components may be fit into an interior chamber 102 of the outer cage component 100.

In another embodiment, the foot support component 200 may fit inside the outer cage component 100 and further the inner upper component 160 may sit on top of the foot support component 200 and fit inside the outer cage component 100. Once the foot support component 200 is fit inside the outer cage component 100, the inner upper component 160 may be fit into an interior chamber 102 of the outer cage component 100 and sit on top of the foot support component 200.

Figure 2A:
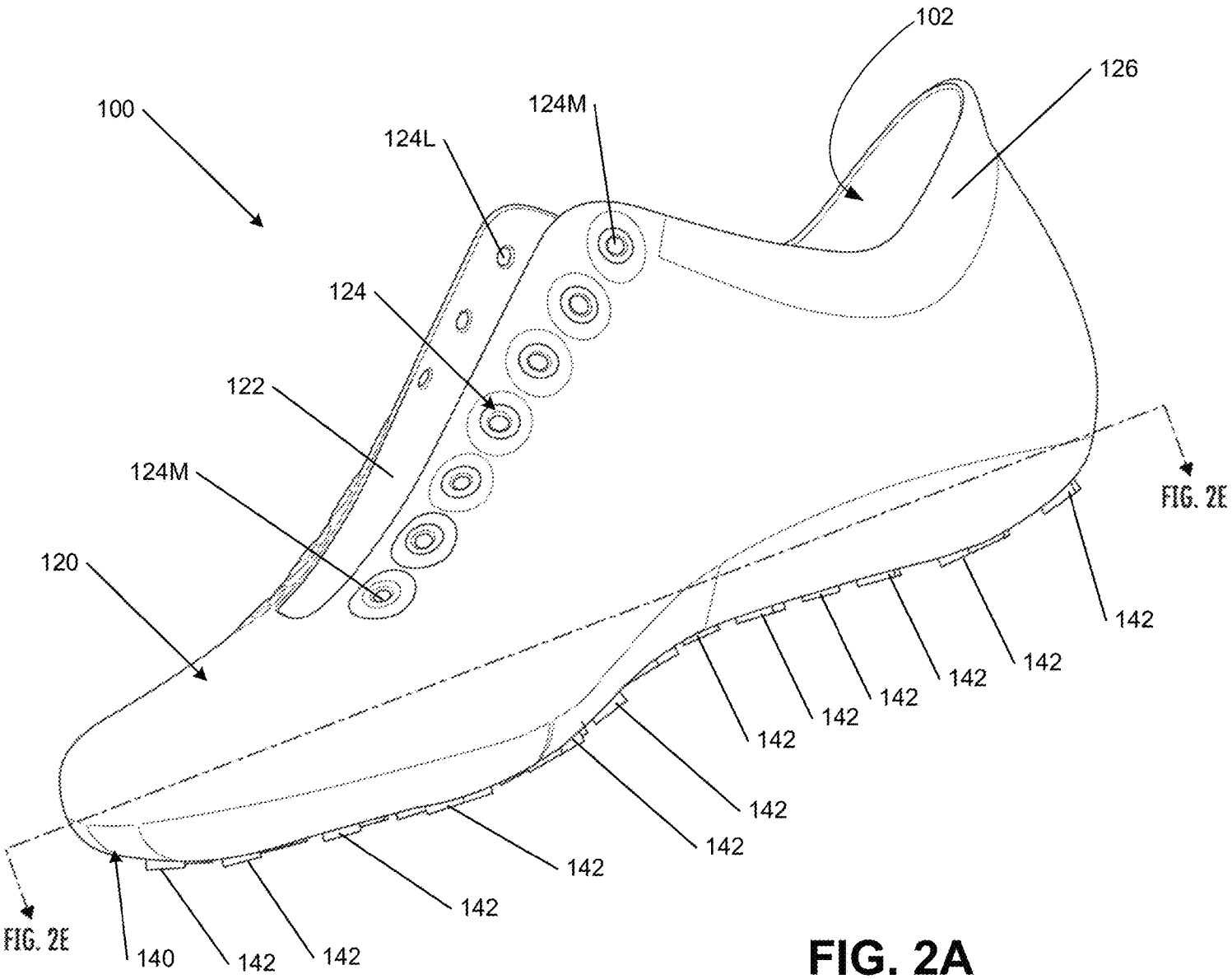
FIGS. 2A-2D provide various views an outer cage component of the article of footwear in FIG. 1 in accordance with some examples of this technology.
Figure 2B:
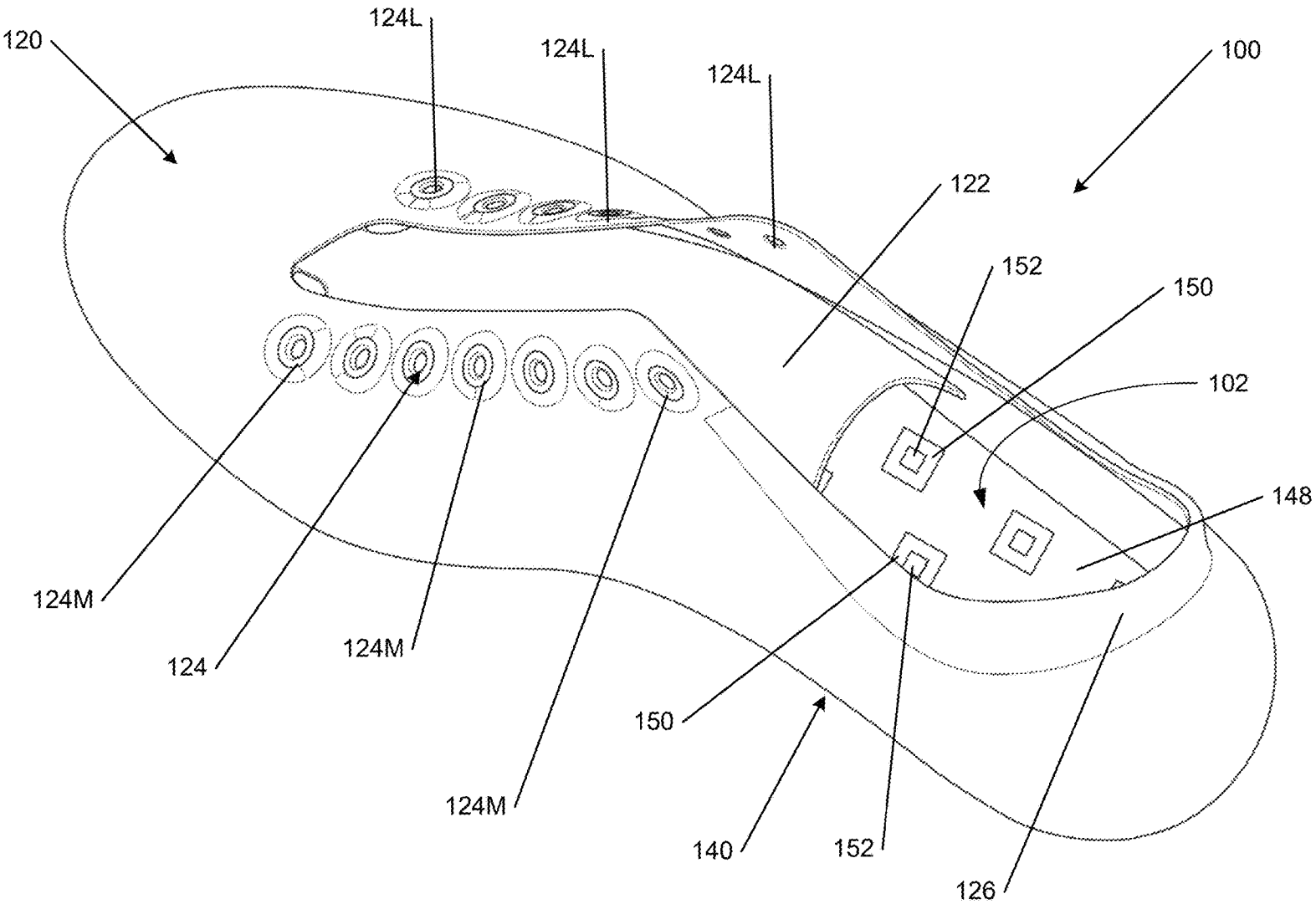
Figure 2C:
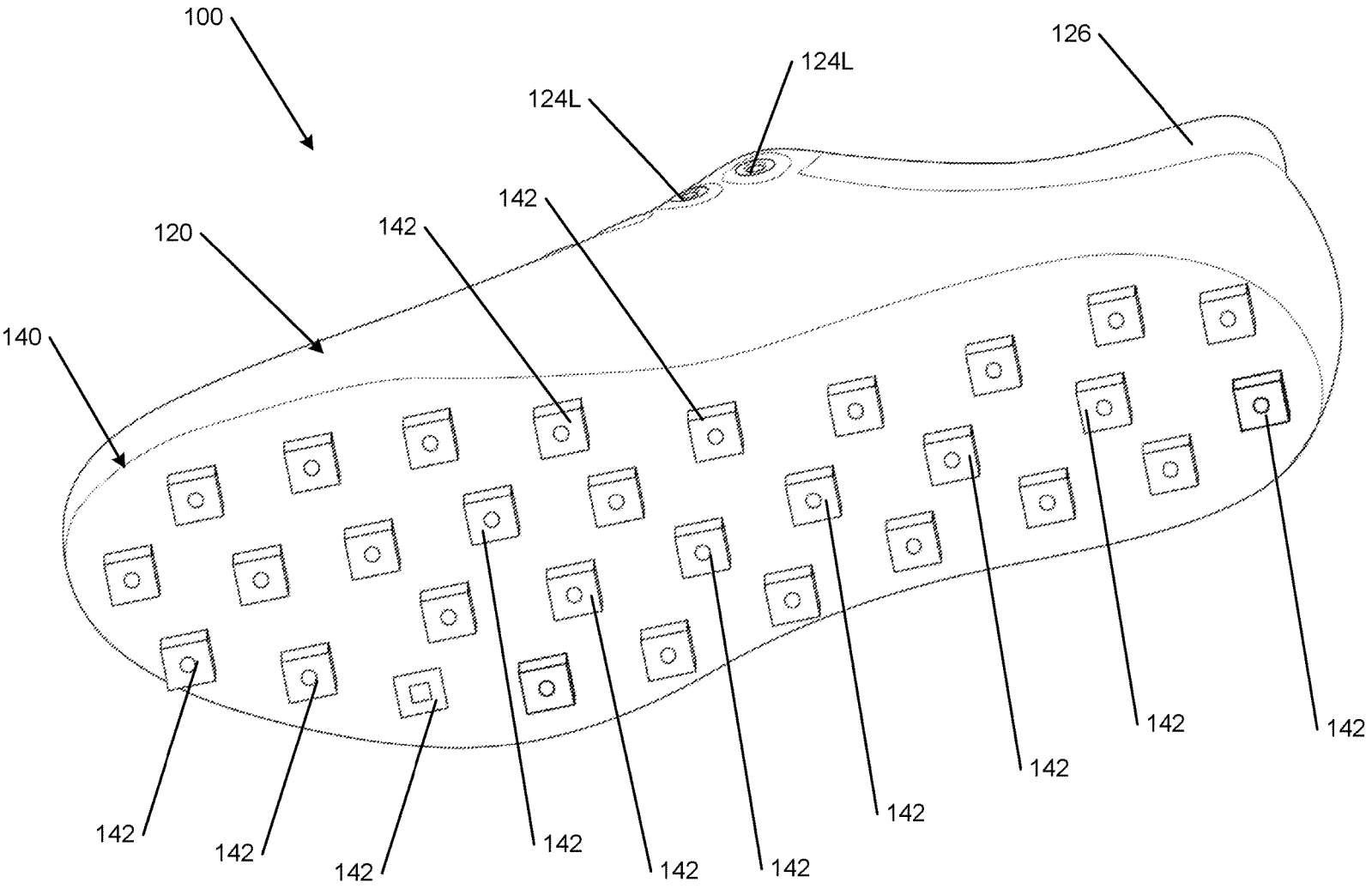
Figure 2D:
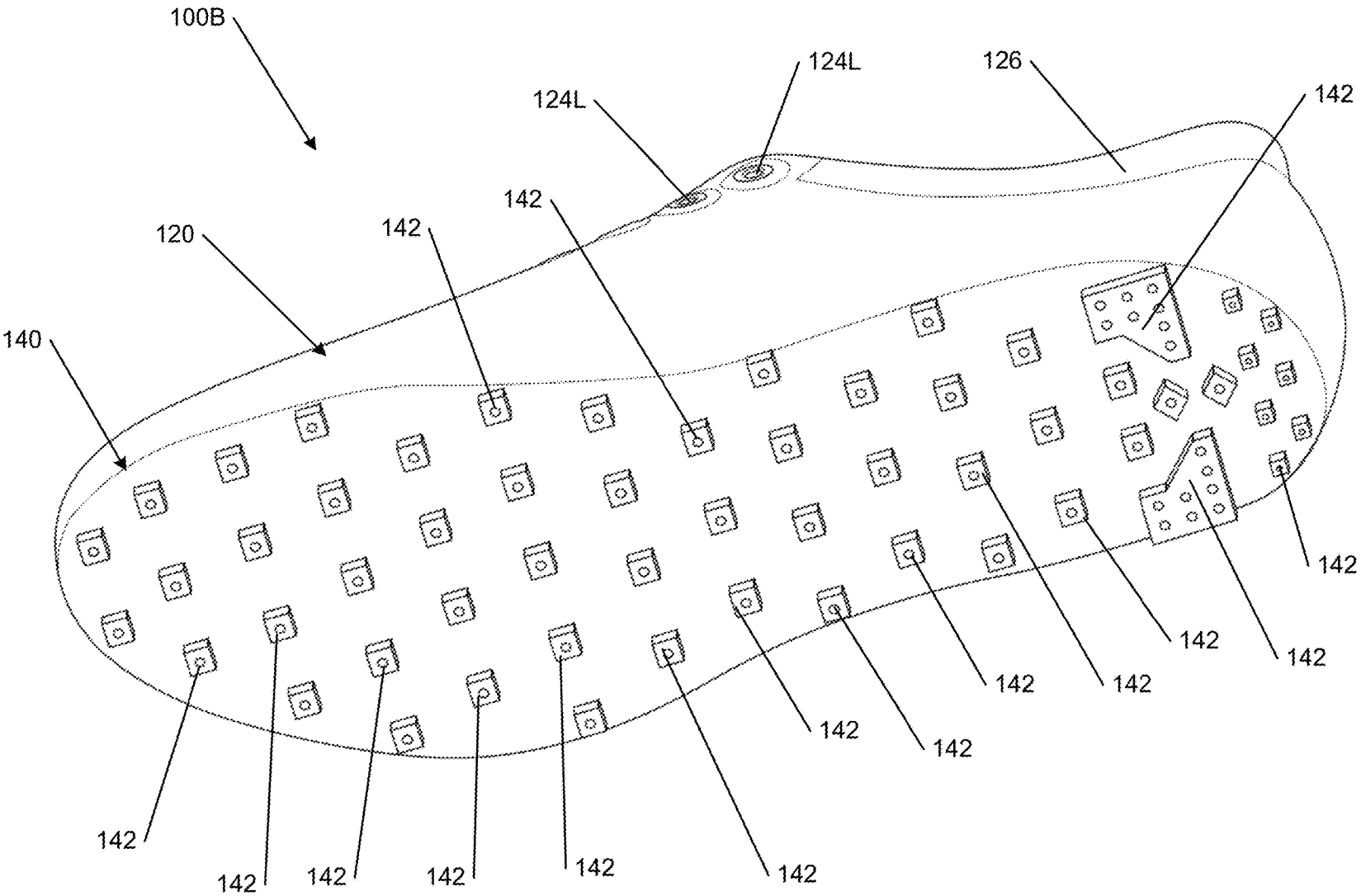
Figure 2E:
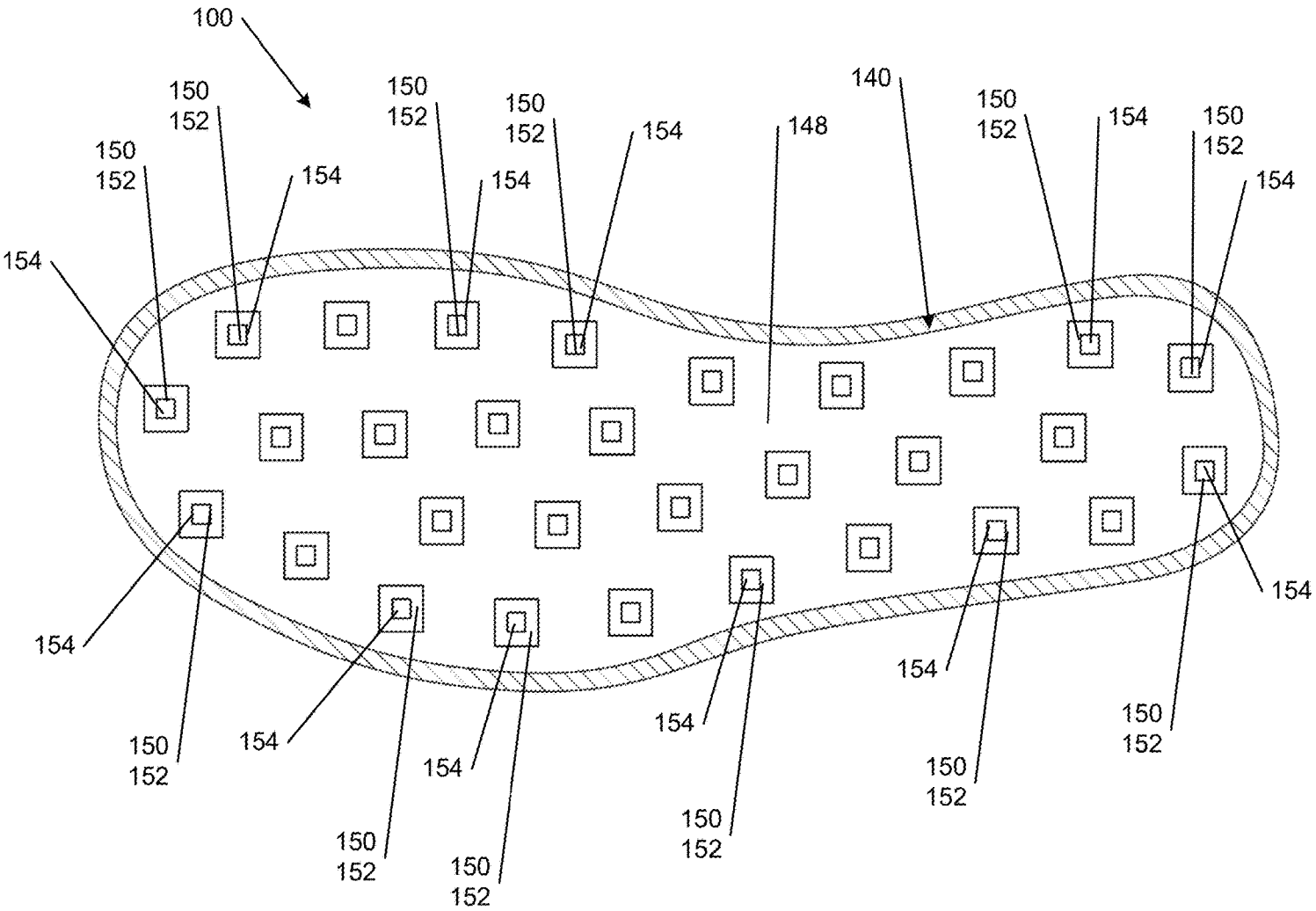
FIG. 2E provides a cross sectional view taken along section line 2E-2E in FIG. 2A of the outer cage component of an article of footwear in accordance with some examples of this technology.

In the figures, FIG. 2A provides a front, medial perspective view; FIG. 2B provides a rear, medial perspective view; and FIG. 2C provides a bottom, medial perspective view of an outer cage component 100 of an article of footwear in accordance with some examples of this technology. FIG. 2D provides a bottom, medial perspective view of another outer cage component 100B of an article of footwear in accordance with some examples of this technology. Further, FIG. 2E provides a sectional view from FIG. 2A along line 2E-2E of the outer cage component 100 of an article of footwear in accordance with some examples of this technology.

The outer cage component 100 may include an upper portion 120 and a sole structure 140 engaged with the upper portion 120. In some examples, the upper portion 120 and sole structure 140 may be formed as a single part (as a unitary, one-piece structure). The upper portion 120 may also be referenced as an "upper." The sole structure 140 may also be referenced as an "outsole portion." The upper portion 120 (which may be formed from one or more parts), potentially together with the sole structure 140, defines a foot-receiving interior chamber 102 for containing a wearer's foot.

As further illustrated in FIGS. 2A-2E, the upper portion 120 of outer cage component 100 may include other components engaged with or integrally formed with the upper portion 120. For example, the upper portion 120 may include a tongue member 122 located across the foot instep area and positioned to moderate the feel of the footwear's closure system on the wearer's foot. The upper 120 may also include a heel counter, a toe cap, or securing straps. Additionally, the upper portion 120 may include a closure system (e.g., including one or more of a lace type closure system, a zippered closure system, a buckle type closure system, elastic stretch elements, etc.). The closure system may include, as illustrated, a plurality of lace engaging openings 124. The article of footwear 10 may further include one or more lace elements extending through the lace engaging openings 124. In the illustrated example, a lace element may extend over the tongue member 122 (for example, in a crisscrossed manner), passing through one or more lace engaging openings 124L, 124M located at a lateral side and a medial side of an instep portion of the upper portion 120 (and/or adjacent a lateral side and a medial side of the instep opening). The lace elements may include a tightening mechanism and/or lock mechanism. The lock mechanism may be located at a rear heel area of the upper portion 120. Further, the upper portion 120 may include a collar 126 extending around opening 102.

As illustrated in FIGS. 2A-2E, the sole structure 140 of the outer cage 100 may include a plurality of traction elements 142 extending from the sole structure 140. As illustrated, the traction elements 142 of this example may be permanently fixed to and/or extending from the sole structure 140 (e.g., by molding, in-molding, rapid manufacturing additive fabrication techniques, or the like). The traction elements 142 may be in the shape of squares or rectangles. The traction elements 142 may be other shapes, such as round, oval, triangular, or other polygons. The traction elements 142 may form an exterior surface for directly engaging the ground (or other contact surface). The illustrated traction elements 142 of this example may have similar structures (albeit potentially with somewhat different sizes and/or shapes). Those skilled in the art will understand, given the benefit of this disclosure, that traction elements 142 may have similar structures, features and/or properties. The traction elements 142 may have any desired sizes or dimensions in accordance with this technology.

Various numbers and sets of traction elements 142 may be provided and located at the various locations along the sole structure 140, such as at the heel area, midfoot area, and/or forefoot area of the sole structure 140 and/or along the lateral (outside) and/or medial (inside) of the sole structure 140. Additionally, the traction elements 142 may be provided and located in various patterns along the sole structure.

As further illustrated in FIGS. 2B and 2E, the sole structure 140 and the interior chamber 102 of the outer cage component 100 may include a footbed portion 148 of the sole structure 140. The footbed portion 148 may extend along the medial and lateral sides from the toe to the heel of the sole structure 140. The footbed portion 148 may include one or more traction element outer shells 150. The traction element outer shells 150 may be defined by holes in the interior chamber 102 and footbed portion 148 of the outer cage component 100, so that the interior of the traction elements 142 are hollowed out, thereby forming the traction element outer shells 150. For each traction element outer shell 150, the footbed portion 148 may also include a recess 152 extending into an interior of the traction element outer shell 150. The recess 152 may be located around the traction element outer shell 150 on the footbed portion 148. Further, each traction element outer shell 150 may include an undercut portion within the interior of the traction element outer shell 150. See also FIGS. 5A and 5B. The interior surface defined by recess 152 may form a closed end having an enlarged or "bulbous" structure beneath the undercut portion. The undercut portion provides a "stop surface" within the interior of the traction element outer shell 150 that engages with and/or cooperates with the traction element inserts 222 as will be explained and detailed below.

An exterior surface of the traction element 142 may define a volume of 2,000 $mm^3$ or less. For example, the volume defined by the exterior surface of the traction element 142 may be within a range of approximately 250 $mm^3$ to 2,000 $mm^3$, or in some examples, between 500 $mm^3$ and 1,500 $mm^3$, or between 750 $mm^3$ and 1,000 $mm^3$.

An interior surface of the traction element outer shell 150 or the recess 152 may define a volume of 1,500 $mm^3$ or less. For example, the volume of interior surface of the traction element outer shell 150 or the recess 152 may be within a range of approximately 300 $mm^3$ to 1,500 $mm^3$, or in some examples, between 400 $mm^3$ and 1,000 $mm^3$, or between 450 $mm^3$ and 900 $mm^3$.

The upper portion 120 and the sole structure 140 may be a one-piece construction. Alternatively, if desired, the upper portion 120 and the sole structure 140 may be engaged together in any desired manner (such as by one or more of adhesives or cements, stitching or sewing, mechanical connectors, etc.), including in manners conventionally known and used in the footwear arts. This would enable the upper portion 120 and sole structure 140 to still be separated, e.g., for recycling, personalization, and/or customization purposes.

The upper portion 120 may be made from any desired material(s) and/or in any desired constructions and/or manners without departing from this technology. As some more specific examples, all or at least a portion of the upper portion 120 (and optionally a majority, substantially all, or even all of the upper portion 120) may be formed as a woven textile component, a knitted textile component, another textile component, a natural leather component, a synthetic leather component, a polymeric component (e.g., a TPU, etc.), a plastic component, etc. The component(s) for upper portion 120 may have structures and/or constructions like those used in footwear products commercially available from NIKE, Inc. of Beaverton, OR and/or other manufacturers, including conventional structures and constructions as are known and used in the art.

Additionally or alternatively, if desired, the upper portion 120 construction may include foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, upper portions 120 and articles of footwear 10 in accordance with this technology may include foot securing and engaging structures of the types used in footwear products commercially available from NIKE, Inc. of Beaverton, Oregon. These types of wrap-around and/or adaptive or dynamic fit structures may at least partially wrap around and securely hold the wearer's foot.

As yet another alternative or additional feature, if desired, upper portions 120 and articles of footwear 10 in accordance with at least some examples of this technology may include fused layers of upper materials, e.g., uppers of the types that include upper materials bonded by hot melt or other adhesive materials, such as in footwear products commercially available from NIKE, Inc. of Beaverton, Oregon. As still additional examples, upper portions of the types described in U.S. Pat. Nos. 7,347,011 and/or 8,429,835 may be used without departing from this technology (each of U.S. Pat. Nos. 7,347,011 and 8,429,835 is entirely incorporated herein by reference).

Figure 3A:
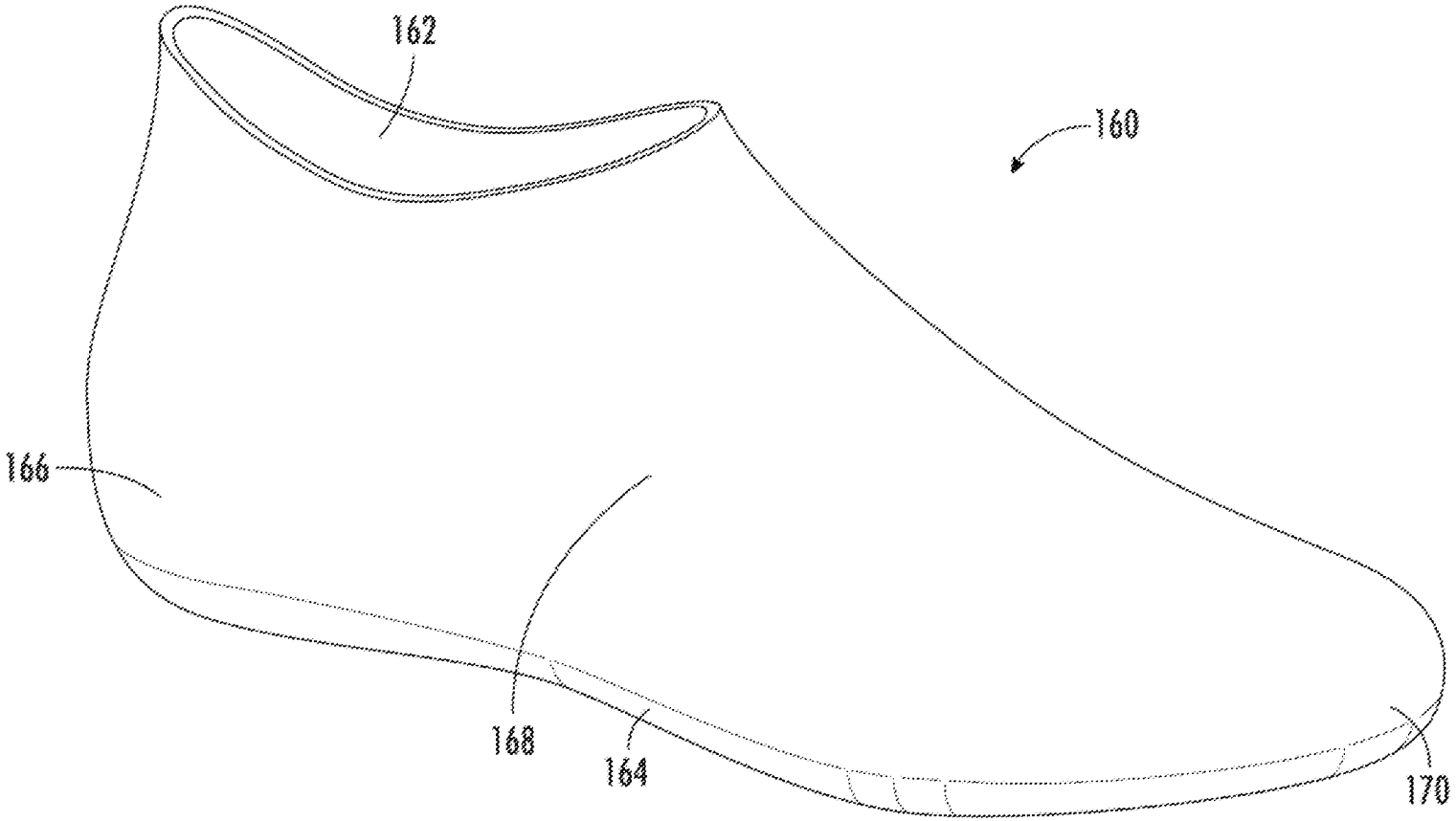
FIGS. 3A and 3B provide views of an inner upper component of an article of footwear in accordance with some examples of this technology.
Figure 3B:
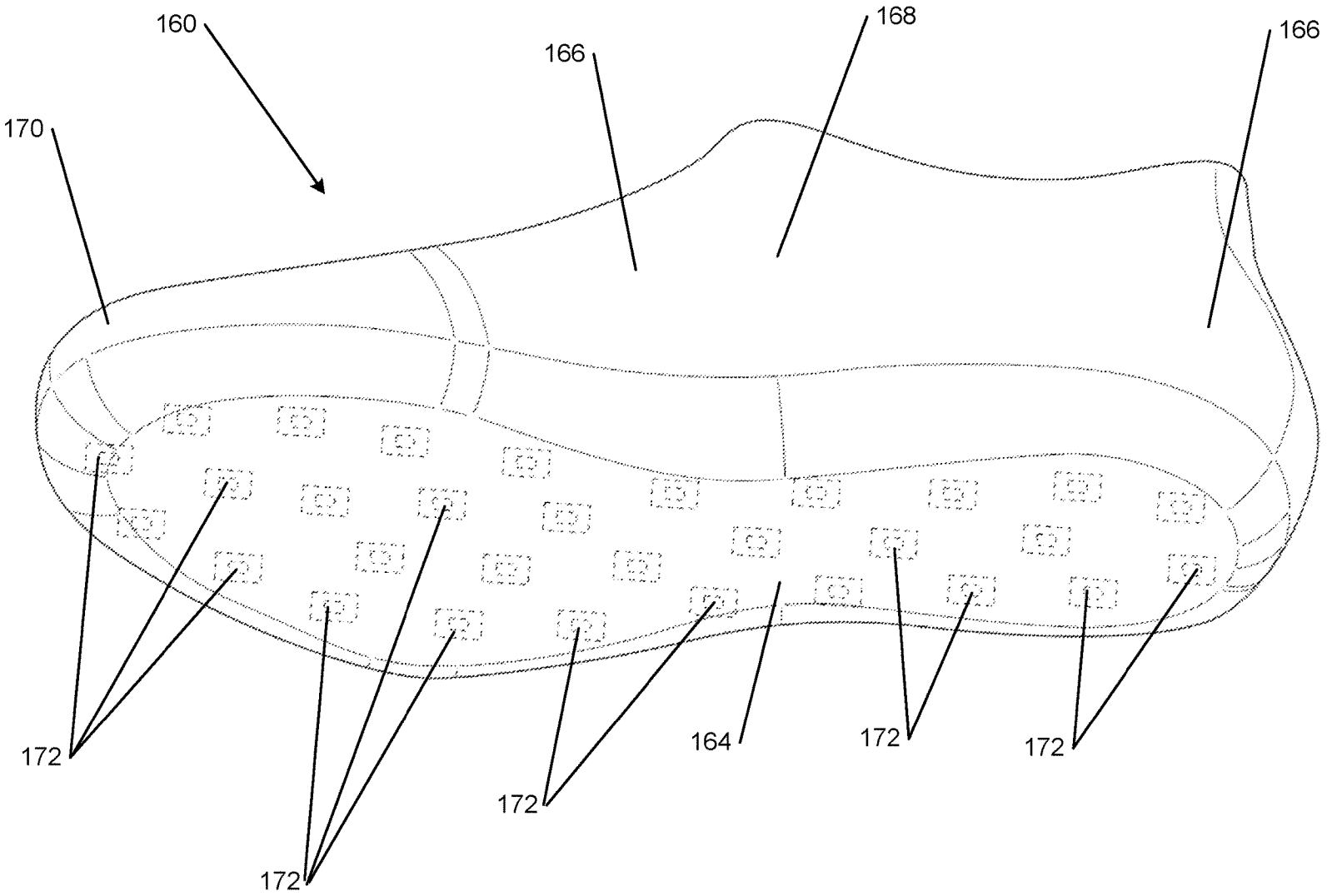

Example articles of footwear 10, an inner upper component 160, and components thereof now will be described in more detail in conjunction with FIGS. 3A and 3B. The inner upper component 160 may be formed as a unitary, one-piece construction that defines a foot-receiving chamber 162. The inner upper component 160 may include bottom surface 164, a heel-containing region 166, a midfoot-containing region 168, and a forefoot-containing region 170. The inner upper component 160 may be formed of a fabric material, such as a knit fabric component (e.g., having a sock-like structure). Further, the bottom surface 164 of the inner upper component 160 may include a plurality of openings 172. Each of the plurality of openings 172 on the inner upper component 160 may at least partially align with each of the recesses 152 and traction element outer shell 150 of the footbed portion 148 of the sole structure 140 on the outer cage component 100.

Figure 4A:
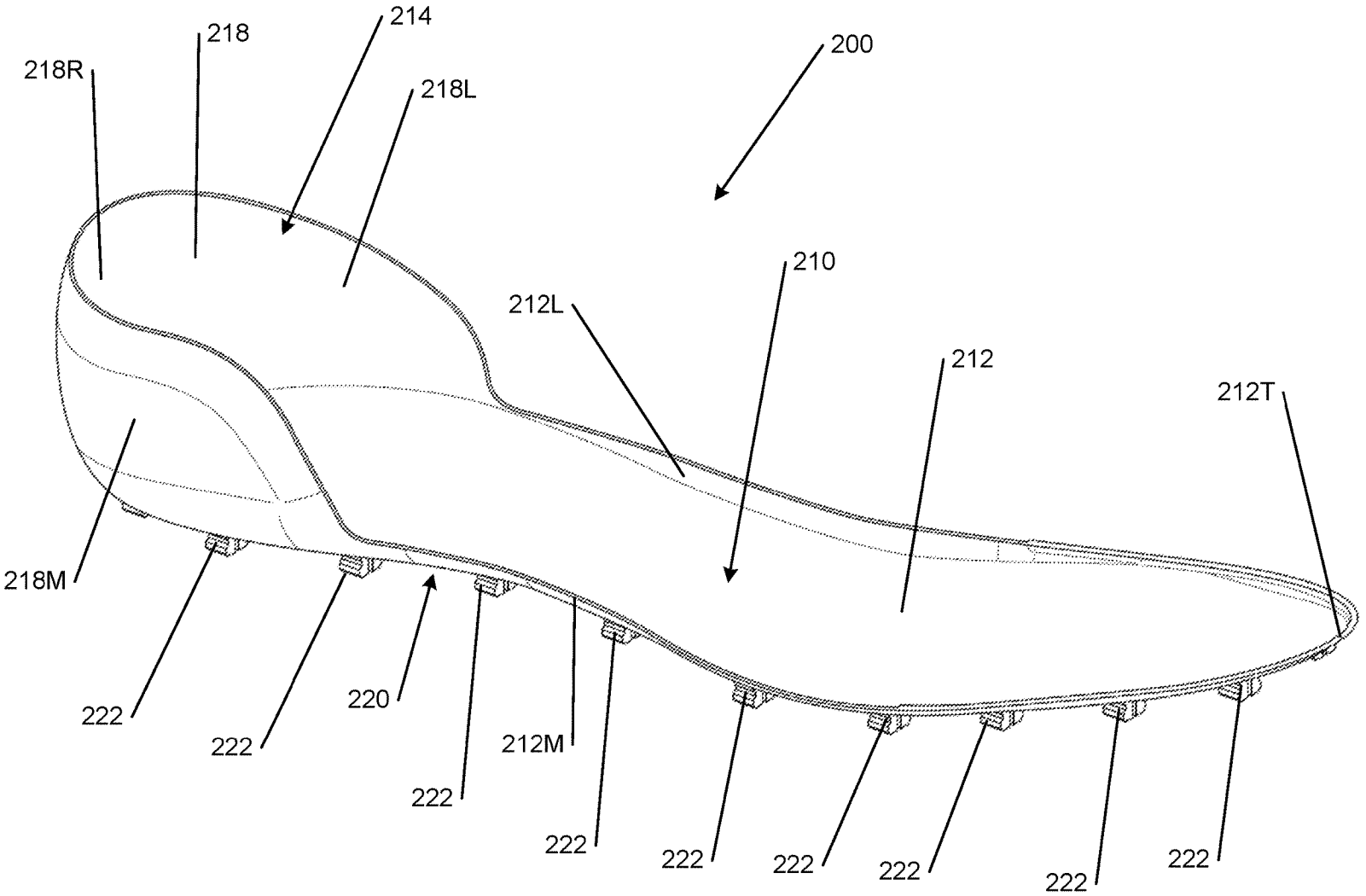
FIGS. 4A and 4B provide views of a foot support component of an article of footwear in accordance with some examples of this technology.

Example articles of footwear 10, a foot support component 200, and components thereof now will be described in more detail in conjunction with FIGS. 4A and 4B. FIG. 4A provides a top, medial perspective view and FIG. 4B provides a bottom perspective view of a foot support component 200 in accordance with some examples and aspects of this technology.

The foot support component 200 may include a chassis and heel counter component with a bottom surface thereof that includes one or more traction element inserts 222 that fit inside the one or more traction element outer shells 150. The foot support component 200 may be formed as a unitary, one-piece construction that includes both a first (top) surface 210 and a second (bottom) surface 220 opposite the first surface 210. The first surface 210 may be utilized for supporting an entire plantar surface of a wearer's foot (or at least some portion thereof). The second surface 220 may include a plurality of flexible traction element inserts 222.

Figure 4B:
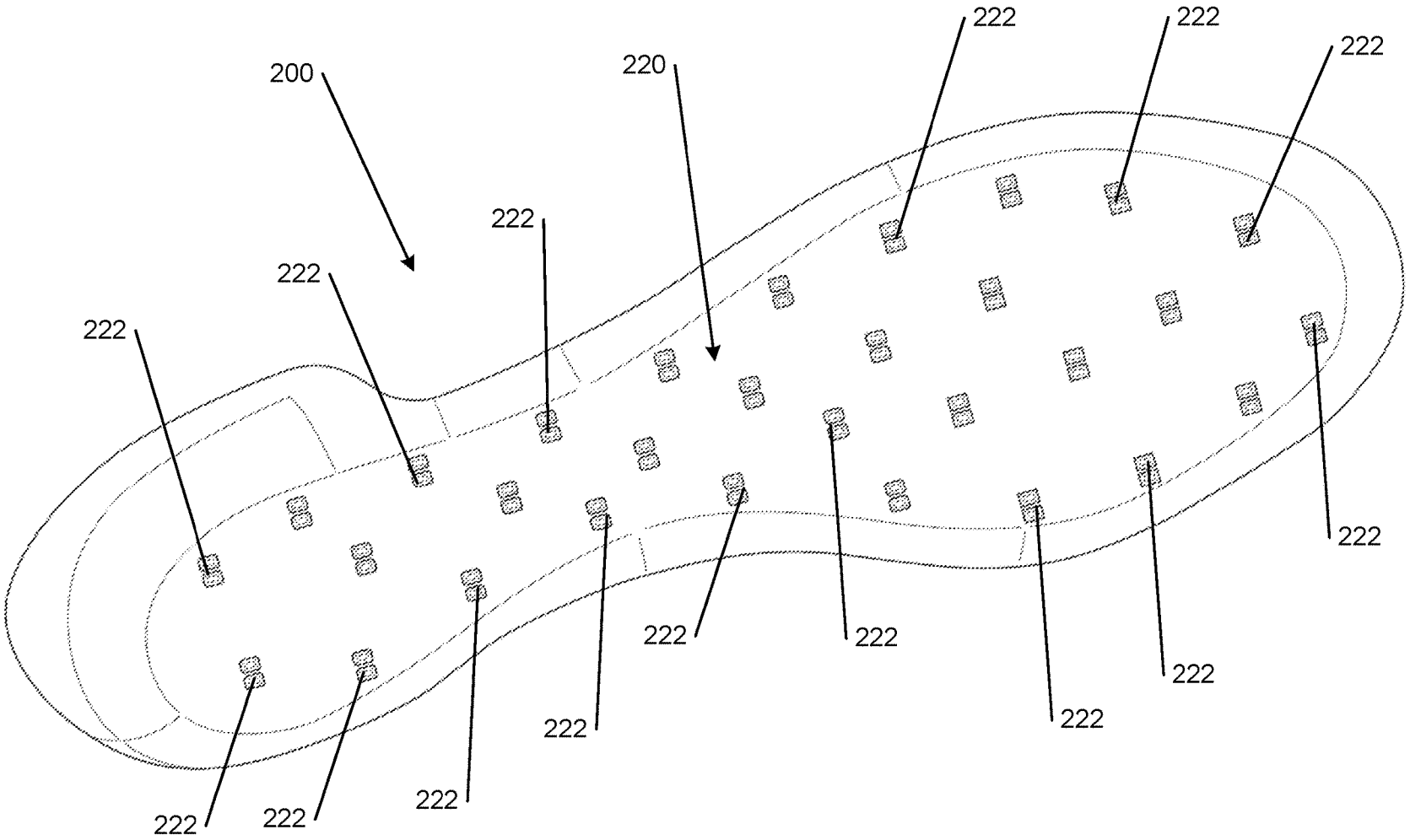

As illustrated in FIGS. 4A and 4B, the top surface 210 may include a top panel 212 and a heel support 214 provided around the heel area of the foot support component 200. The heel support 214 may provide additional support for the heel area of a wearer's foot (e.g., akin to a heel counter structure). As illustrated in FIG. 4A, the top panel 212 may include a lateral rim 212L and a medial rim 212M. The lateral rim 212L may extend from the top panel 212 around at least a portion of the perimeter of the lateral side of the foot support component 200. The medial rim 212M may extend from the top panel 212 around at least a portion of the perimeter of the medial side of the foot support component 200. Additionally, the top panel 212 may include a toe rim 212T that extends from the top panel 212 and around at least a portion of the top perimeter of the toe area of the foot support component 200.

The top panel 212 may also include recesses (not shown). The recesses may provide "gripping structures" (e.g., for engaging and preventing the slipping of a wearer's foot within the article of footwear 10, for preventing an interior footwear component, such as an insole provided within the foot support component 200 from moving within the footwear interior), may provide flexibility (e.g., to assist in inserting the foot support component 200 into inner upper component 160 and/or the outer cage component 100), and/or may reduce weight of the foot support component 200. The recesses may include a plurality of polygons, specifically hexagons (although other shapes may be used), distributed on the top panel 212. The recesses may be provided along the heel area and the mid-foot area of the top panel 212 and the foot support component 200. The recesses may also include other shapes, such as other polygons, shapes, ridges, dimples, circles, stars, or through holes. The recesses may also extend along other portions of the top panel 212 and the foot support component 200, such as along the toe area, the mid-foot area, and/or the heel area or any combination thereof these areas.

The heel support 214 may constitute a heel counter structure 218, e.g., to limit or control movement of the heel. The heel counter structure 218 may be an integrally formed structure with the foot support component 200. The heel counter structure 218 may include a heel counter lateral sidewall 218L, a heel counter medial sidewall 218M, and a heel counter rear sidewall 218R formed between the heel counter lateral sidewall 218L and the heel counter medial sidewall 218M. As illustrated in FIG. 4A, the heel counter structure 218 may be a full and closed counter structure at the rear heel area. In other embodiments as will be explained further below, the heel counter structure 218 may include structures with openings or grooves around the heel area.

FIG. 4B illustrates the second (bottom) surface 220 and the foot support component 200 with a plurality of flexible traction element inserts 222. The flexible traction element inserts 222 may at least partially align with each of the traction elements 142, recesses 152, and traction element outer shells 150 of the sole structure 140 on the outer cage component 100. The flexible traction element inserts 222 may be sized, shaped, and located for one traction element insert 222 to fit into and extend into one traction element 142 and recess 152 of the traction element outer shell 150. In another embodiment, two or more traction element inserts 222 may be sized, shaped, and located to fit into and extend into one traction element 142 and recess 152 of the traction element outer shell 150.

Figure 5A:
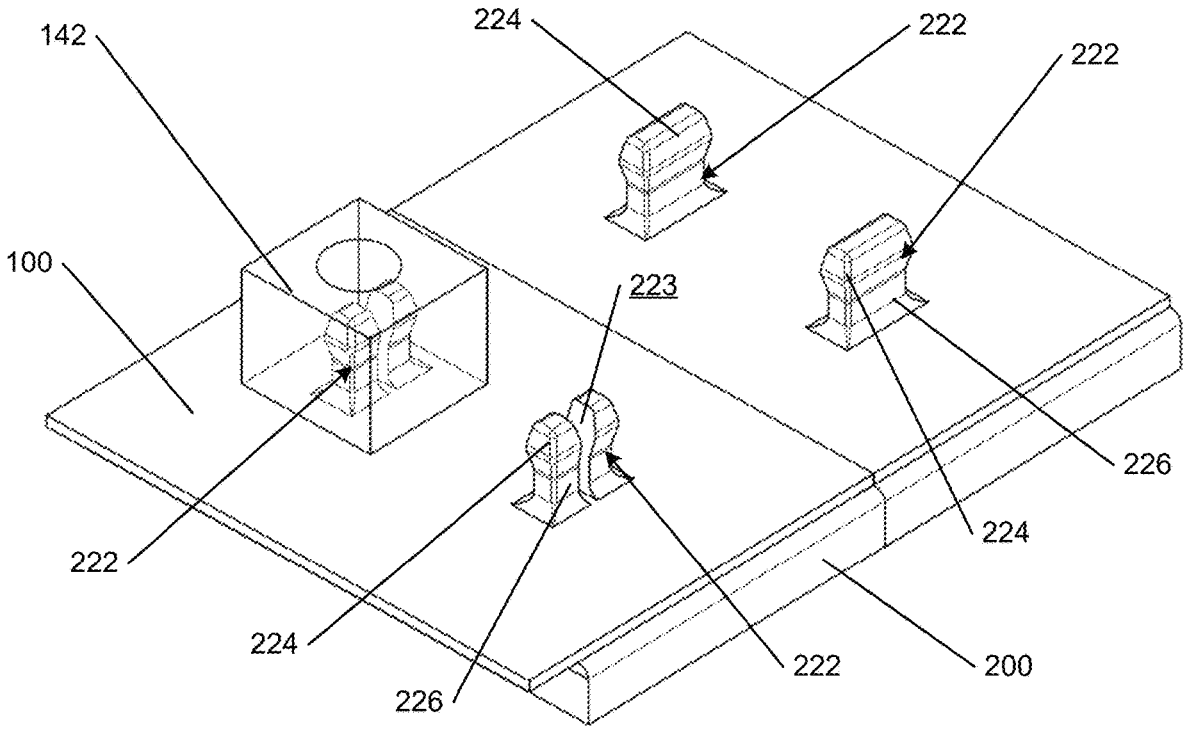
FIGS. 5A and 5B provide side perspective views of traction element inserts engaged with traction element outer shells in accordance with examples and aspects of this technology.
Figure 5B:
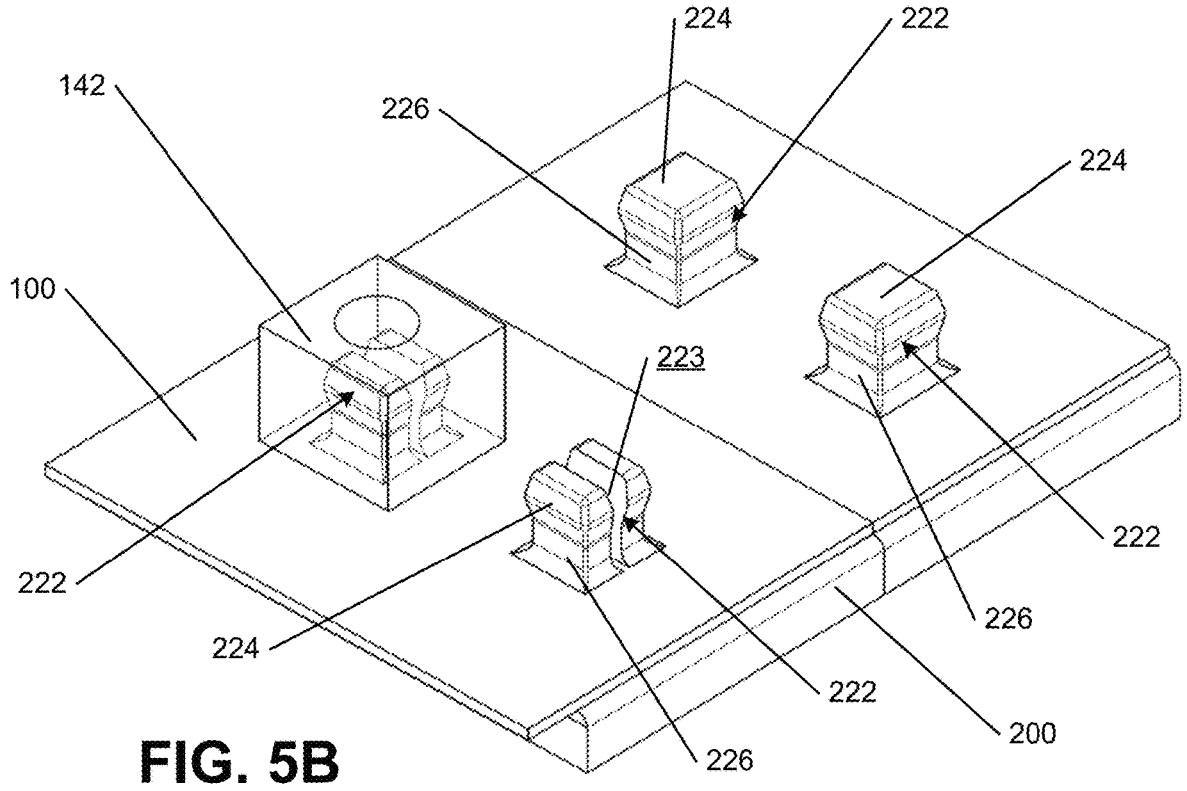

As illustrated specifically in FIGS. 4B, 5A, and 5B, the flexible traction element inserts 222 may include an enlarged free end 224 extending from a traction element arm 226. The free end 224 may be positioned to engage the undercut portion 154 within the interior of the traction element outer shell 150 and secure the traction element insert 222 within the recess 152 of the traction element outer shell 150. Further, the free end 224 of the example flexible traction element inserts 222 may have two enlarged traction element components arranged around an intersection of a flex groove or slit (e.g., with one separate traction element component provided on each side of the flex groove or slit). Other flexible traction element structures and arrangements are possible without departing from this invention. For example, a flexible traction element insert 222 may include four "fin-type" enlarged traction element components arranged around an intersection of two flex grooves or slits (e.g., with one separate traction element component provided in each quadrant or sector around the flex grooves or slits). In another example, a flexible traction element insert 222 may include three traction element components arranged around a "capital T-shaped" junction or intersection of two flex grooves (either or both of the flex grooves may have curvature, if desired). As another example, a flexible traction element insert 222 may include three traction element components arranged around a "capital Y-shaped" junction or intersection of three flex grooves, e.g., arranged at any desired angles (one or more of these flex grooves may have curvature, if desired). While other specific shapes and arrangements are possible, traction element components may have shapes similar to the fin-type enlarged traction element components described above (and may have any of the various specific structural features and/or options described above for enlarged traction element components). In another example, a traction element component with more of a T-shaped structure, may have a structure akin to two adjacent traction element components pushed together so that one extended wall or side faces the groove. The illustrated traction element inserts 222 of this example may have similar structures (albeit potentially with somewhat different sizes and/or shapes). Those skilled in the art will understand that traction element inserts 222 may have similar structures, features and/or properties. The traction element inserts 222 may have any desired sizes, shapes, orientations, or arrangements on the footwear sole structure in accordance with this technology.

FIGS. 5A and 5B illustrates the interaction of a traction element insert 222 and a traction element 142 for flexible traction element structures and arrangements. FIG. 5A illustrates an elongated rectangular-shaped traction element insert 222 with a slit and without a slit and a corresponding elongated rectangular-shaped traction element 142. FIG. 5B illustrates an elongated square-shaped traction element insert 222 with a slit and without a slit and a corresponding elongated square-shaped traction element 142. The traction element 142 may include a recess 152 with the traction element outer shell 150 formed to include an undercut portion 154. The traction element insert 222 may include an enlarged end 224 that extends into the recess 152. As the traction element insert 222 is pushed into the recess 152, the enlarged end 224 may push past the undercut portion 154 into the recess 152 to lock and hold the traction element insert 222 in the traction element 142 within the recess 152 and the traction element outer shell 150. For the traction element insert 222 with a slit 223, the traction element insert 222 may resiliently spring back (splay outward) to enlarge, hold, and lock the traction element insert 222 in the traction element 142 within the recess 152 and the traction element outer shell 150. Other shapes of traction element inserts 222 and traction elements 142 may be utilized without departing from the invention. Various dimensions may be utilized with the traction element insert 222 and the traction element 142 as illustrated in FIGS. 5A and 5B. For example, the inner traction element insert 222 may be approximately 2 mm wide by approximately 7 mm tall. The inner traction element insert 222 may also be within a range of approximately 1-3 mm wide by approximately 5-9 mm tall without departing from the inventions. Additionally, the traction element 142 may include a wall thickness of approximately 0.8 mm, or within a range of 0.5-2.5 mm thickness, or within a range of 0.5-1.5 mm thickness. For example, an overhang of the enlarged end 224 on the traction element insert 222 may be approximately 0.5 mm, or within a range of 0.2-0.8 mm. The enlarged end 224 may be approximately 0.8 mm tall, or within a range of 0.5-1.5 mm tall. Other dimensions may be utilized as these dimensions are examples. Based on different stress areas throughout the foot support component 200 and/or the outer cage component 100, the traction element inserts 222 and the traction element outer shells 150 may be different sizes, shapes, orientations, or arrangements on the footwear sole structure.

Figure 6A:
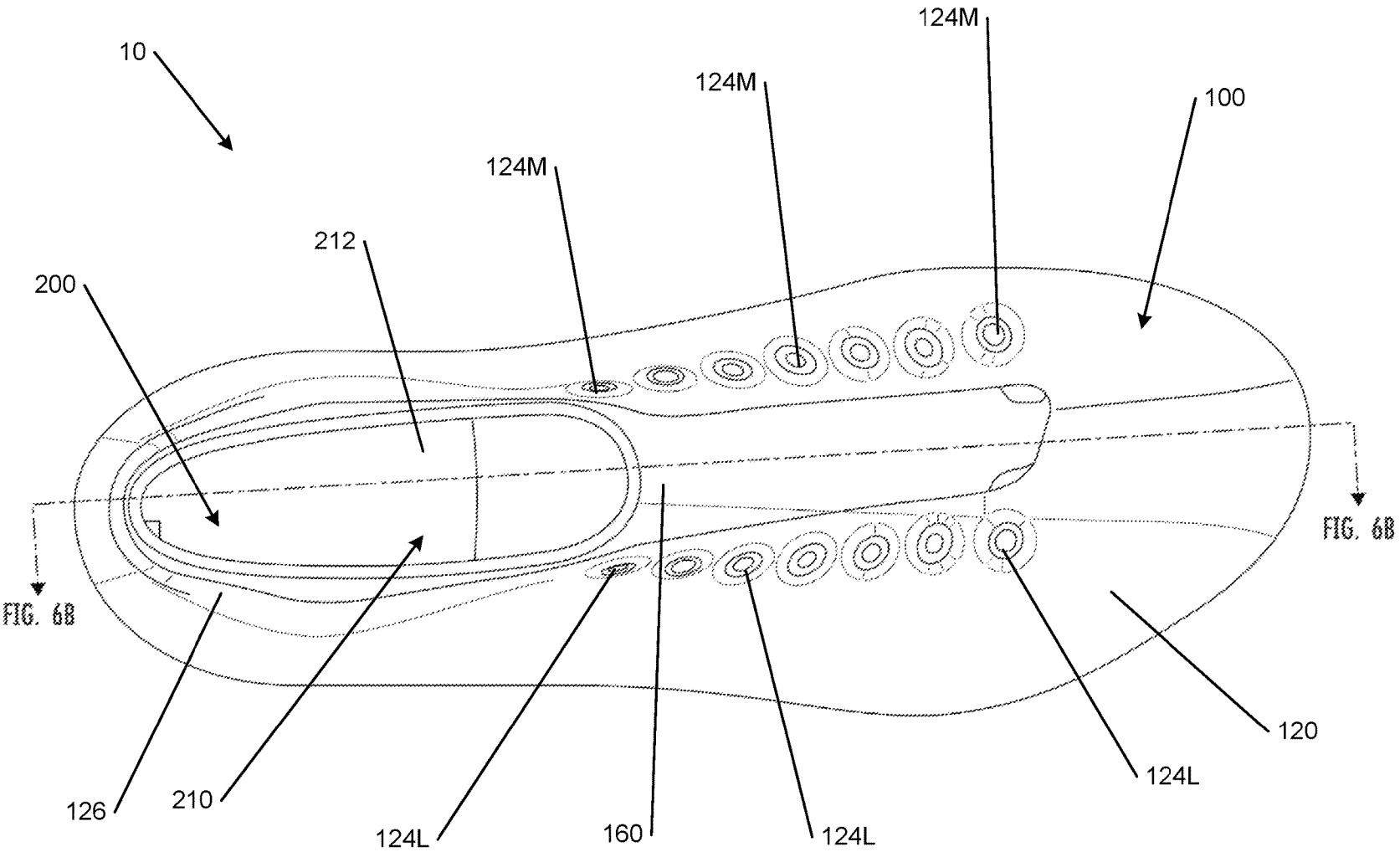
FIG. 6A provides a top view of an article of footwear in accordance with some examples of this technology.
Figure 6B:
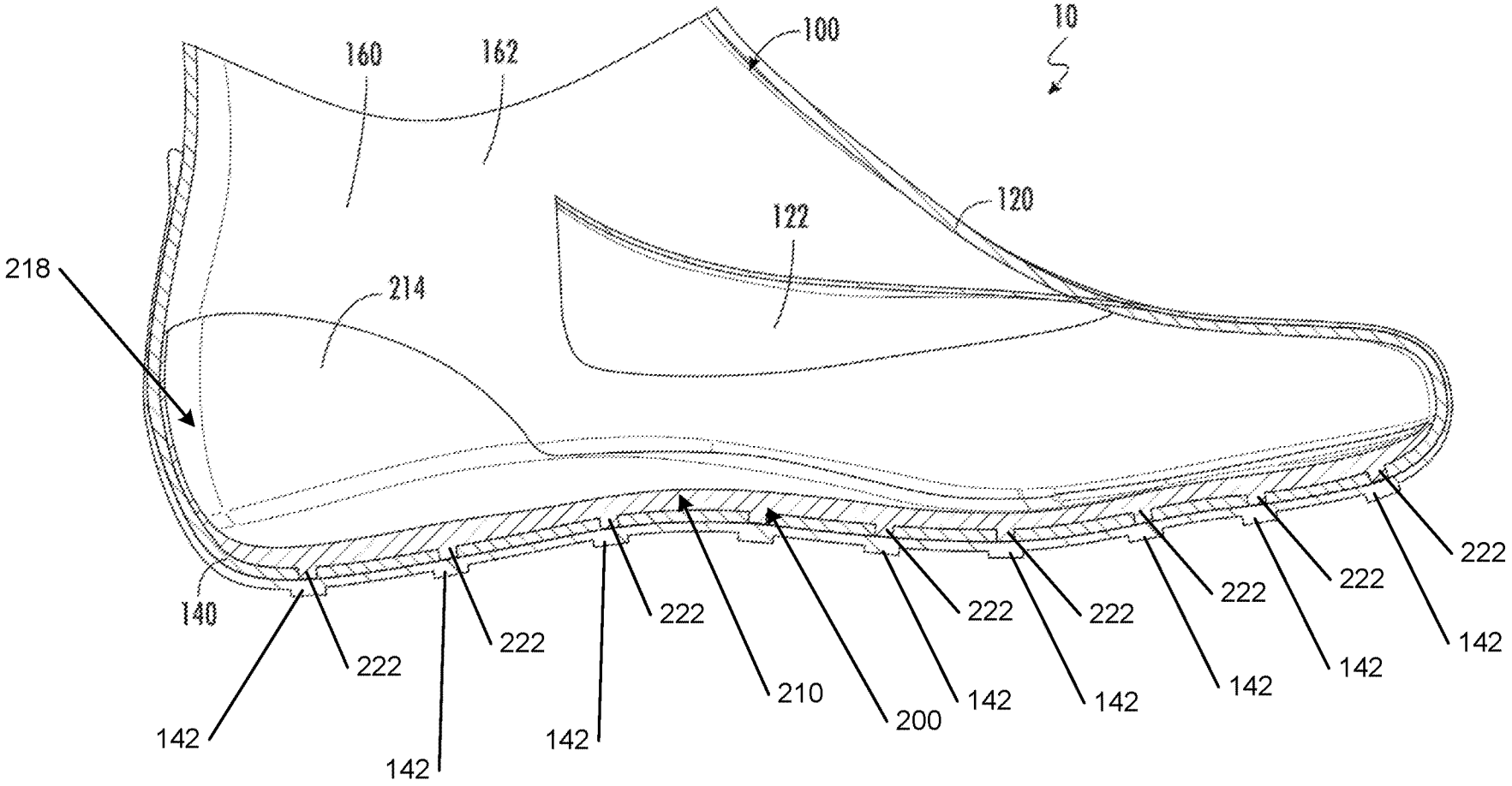
FIG. 6B provides a cross sectional view taken along section line 6B-6B in FIG. 6A of the article of footwear in accordance with some examples of this technology.

Example articles of footwear 10 and components thereof now will be described in more detail in conjunction with FIGS. 6A-6C. FIG. 6A provides a top view; FIG. 6B provides a sectional view along line 6B-6B from FIG. 6A; and FIG. 6C provides a rear perspective cutaway view of the article of footwear 10 highlighting the engagement between the traction element insert 222 of the foot support component 200 and the traction element outer shell 150 of the outer cage component 100 in accordance with some examples and aspects of this technology.

FIGS. 6A and 6B illustrate an exemplary article of footwear 10 with all of the components together to include the outer cage component 100, the inner upper component 160, and the foot support component 200. As illustrated, the foot support component 200 may fit inside the inner upper component 160. Further, the inner upper component 160 and the foot support component 200 together may fit inside the outer cage component 100. Once the foot support component 200 is fit inside the inner upper component 160, the combined components of the foot support component 200 and the inner upper component 160 may be fit into an interior chamber 102 of the outer cage component 100. The foot support component 200 may be oriented so that traction element inserts 222 extend through respective openings in the inner upper component 160 and into respective recesses 152 of traction element outer shells 150. In at least some examples of this technology, a separate insole component, interior midsole component, or other comfort-enhancing component may be provided over the top surface 210 of the foot support component 200, e.g., to prevent direct contact between the foot support component 200 and the wearer's foot.

FIGS. 6B and 6C illustrate the enlarged free end 224 of the traction element insert 222 of foot support component 200 fitting inside and engaging with the traction element outer shell 150 and the undercut portion 154 of the traction element outer shell 150 on the outer cage component 100. As illustrated in the above views, the recesses 152 of the traction element outer shells 150 are formed to include an undercut portion 154 (e.g., the undercut portion 154 providing an opening to a bulbous closed end of the recess 152), and the traction element inserts 222 include an enlarged end 224 (e.g., a bulbous free end), e.g., formed with enlarged traction element components that extend into the recesses 152. The flexible groove or slit 223 in the traction element insert 222 may narrow with the enlarged traction element components moving inward towards the flexible groove or slit 223 as the traction element insert 222 is being pushed past the undercut portion 154 into the recess 152 and toward the closed end of the traction element outer shell 150. Once the enlarged traction element components of the traction element insert 222 pass beyond the undercut portion 154, the enlarged traction element components of the traction element insert 222 may resiliently spring back (splay outward) to enlarge the flexible groove or slit 223 and hold the traction element insert 222 within the traction element outer shells 150. The bulbous free end of the traction element insert 222 formed by the enlarged traction element components extends into the bulbous closed end of the recess 152 and will contact the undercut portion 154 to prevent the traction element insert 222 from easily pulling out of the recess 152. The traction element insert 222 also may provide interior reinforcement or support for the overall traction element construction (e.g., helps prevent the traction element outer shell 150 from collapsing under applied force to the ground). Other spring elements or biasing components may be provided to help the enlarged traction element components (or other retaining structures) spring back to their enlarged spacing to providing this engagement feature.

The outer cage component 100 and/or the foot support component 200 may include a rigid plastic material. For example, the rigid plastic material may include one or more (combination) of the following: thermoplastic polyurethane (TPU), polyurethane, nylon, acrylic or polymethyl methacrylate (PMMA), polycarbonate (PC), polyethylene (PE), polypropylene (PP), polyethylene terephthalate (PETE or PET), polyvinyl chloride (PVC), or acrylonitrile-butadiene-styrene (ABS). Other rigid plastic materials may be utilized for the outer cage component 100 and/or the foot support component 200. The outer cage component 100 and/or the foot support component 200 may be made of other materials similar to and having similar material properties to rigid plastic materials. Various thicknesses and hardness properties may be utilized for the outer cage component 100 and/or the foot support component 200.

In at least some examples of this technology, the volume defined by the interior surface of the recess 152 ($V_{RES}$) and the volume defined by the outer surface of the traction element insert 222 ($V_{INS}$) within the recess 152 when fully inserted into the recess 152 may be substantially equal. As some more specific examples, ratio of $V_{INS}$:$V_{RES}$ may be within a range of 0.75 to 1, and in some examples, from 0.75 to 0.99, 0.75 to 0.95, 0.8 to 1, 0.8 to 0.99, or even 0.8 to 0.95. Additionally or alternatively, in at least some examples of this technology, at least 75% (and in some examples, at least 80%, at least 85%, at least 90%, at least 95%, or even at least 98%) of an exterior surface area of the traction element insert 222 within the insert may directly contact and/or lie immediately adjacent the interior surface of the recess 152. A tight fit with little extra open space within the recess 152 helps prevent undesired "play" or movement of the traction element inserts 222 within their respective recesses 152.

Further, in at least some examples of this technology, the traction element inserts 222 extending into their respective recesses 152 (e.g., the engagement of the free ends of traction element inserts 222 with the undercut surfaces 154) will be the only connector structures holding the foot support component 200 to the outer cage component 100 and/or to the remainder of the footwear structure. Additionally or alternatively, in at least some examples of this technology, the traction element inserts 222 extending into their respective recesses 152 (e.g., the engagement of the free ends of traction element inserts 222 with the undercut surfaces 154) will be the only connector structures holding the inner upper component 160 with the rest of the footwear structure (e.g., its only connection with the foot support component 200 and/or the outer cage component 100). Thus, the footwear structure of these examples may be very environmentally friendly and have improved sustainability, e.g., by avoiding use of adhesives. In other embodiments, the traction element inserts 222 may extend through and/or penetrate the traction element outer shells 150 and/or the traction elements 142.

When one or more of the components' useful life ends, one or more of the components of the article of footwear 10 may be pulled apart, such as by pulling the traction element inserts 222 out of the traction element outer shells 150. For example, the foot support component 200 and the traction element inserts 222 may be pulled out of the outer cage component 100 and traction element outer shells 150. The parts, such as the outer cage component 100, the inner upper component 160, and the foot support component 200 may then be easily recycled and replaced.

Various numbers of traction element inserts 222 and traction elements 142 may be engaged and correspond with each other for the article of footwear 10. For example, one or more traction element inserts 222 may correspond and engage with one or more recesses 152 in the traction element outer shells 150. In another example, two traction element inserts 222 may correspond and engage with two recesses 152 in the traction element outer shells 150. In another example, three or more traction element inserts 222 may correspond and engage with three or more recesses 152 in the traction element outer shells 150. Any of the traction element inserts 222 located throughout the foot support component 200, such as along the toe portion, heel portion, or midsection of the foot support component 200, may engage with a corresponding recess 152 in the traction element outer shell 150 located in the similar location along the outer cage component 100, along the toe, heel, or midsection of the outer cage component 100.

This type of removable engagement, when used, is advantageous because it allows individual replacement of parts (e.g., the outer cage component 100, the inner upper component 160, and/or the foot support component 200) and/or separation of parts (e.g., the outer cage component 100, the inner upper component 160, and/or the foot support component 200) for potential recycling, personalization, and/or customization purposes. Additionally or alternatively, this type of removable engagement, when used, is advantageous because it allows the user to create a customized shoe for the user, e.g., traction, traction element location, geometry of the shoe, geometry of the user's foot, position of the traction elements, type of the traction elements, and/or size of the traction elements, etc. Additionally or alternatively, this type of removable engagement, when used, is advantageous because it allows the user to swap out the individual parts for other parts, e.g., depending on the activity to be conducted. More specifically, different outer cage components 100, inner upper components 160, foot support components 200, and/or combinations thereof may be used for different activities, e.g., to provide better traction, better support, and/or other desired characteristics for the specific activity. As an even more specific example, the same inner upper component 160 and foot support component 200 combination may be used (and switched between) two different outer upper components 100, e.g., one outer upper component 100 designed for one lifestyle-type activity (e.g. cross-training) and another upper component 100 designed for a second lifestyle-type activity (e.g. yoga). Additionally or alternatively, different outer cage components 100, inner upper components 160, foot support components 200, and/or combinations thereof may be used based on a user's preferences at a specific time (e.g., for different colors and/or color combinations, etc.).

Figure 7A:
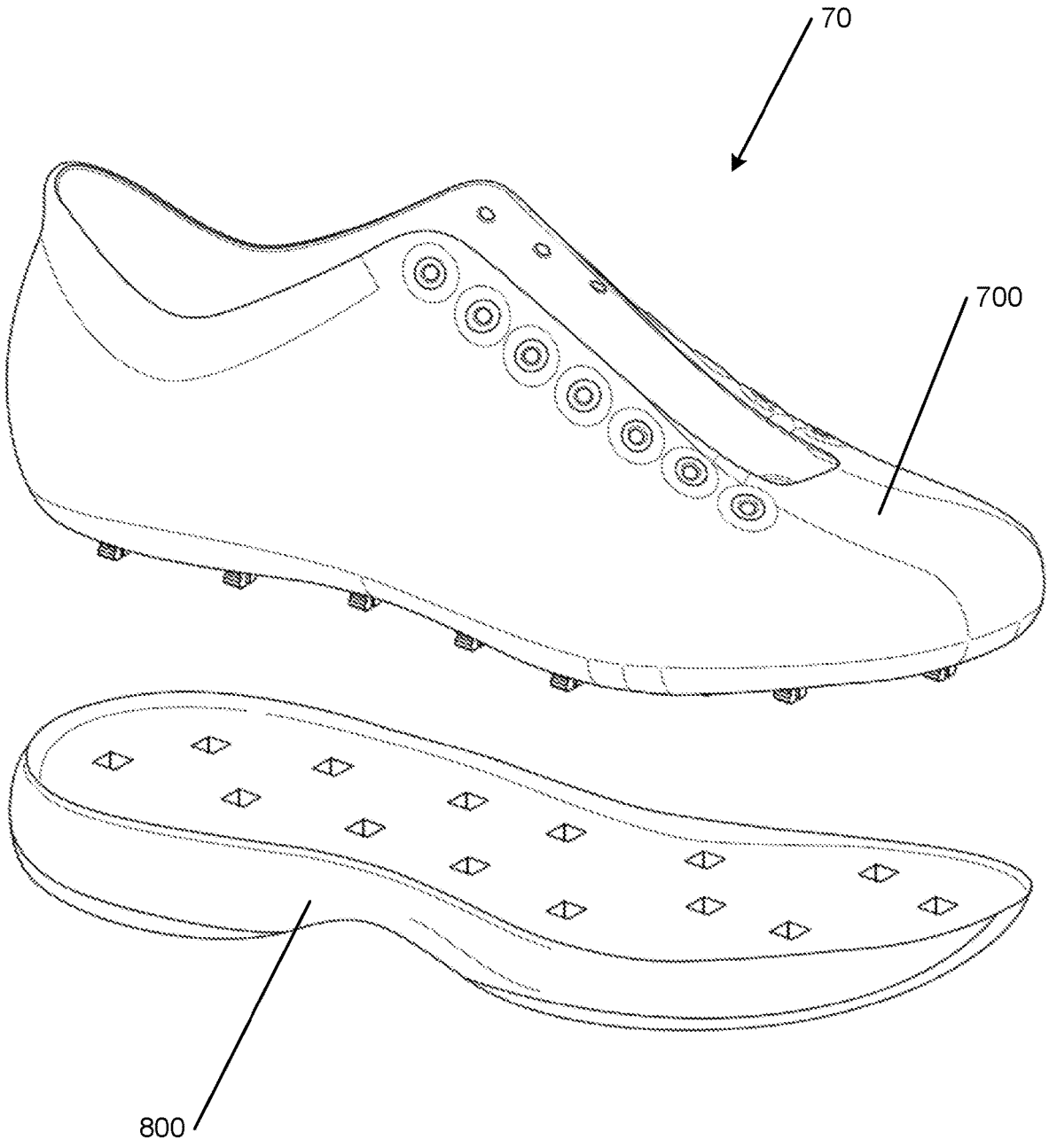
FIG. 7A provides a component view of another article of footwear in accordance with some examples of this technology.
Figure 7B:
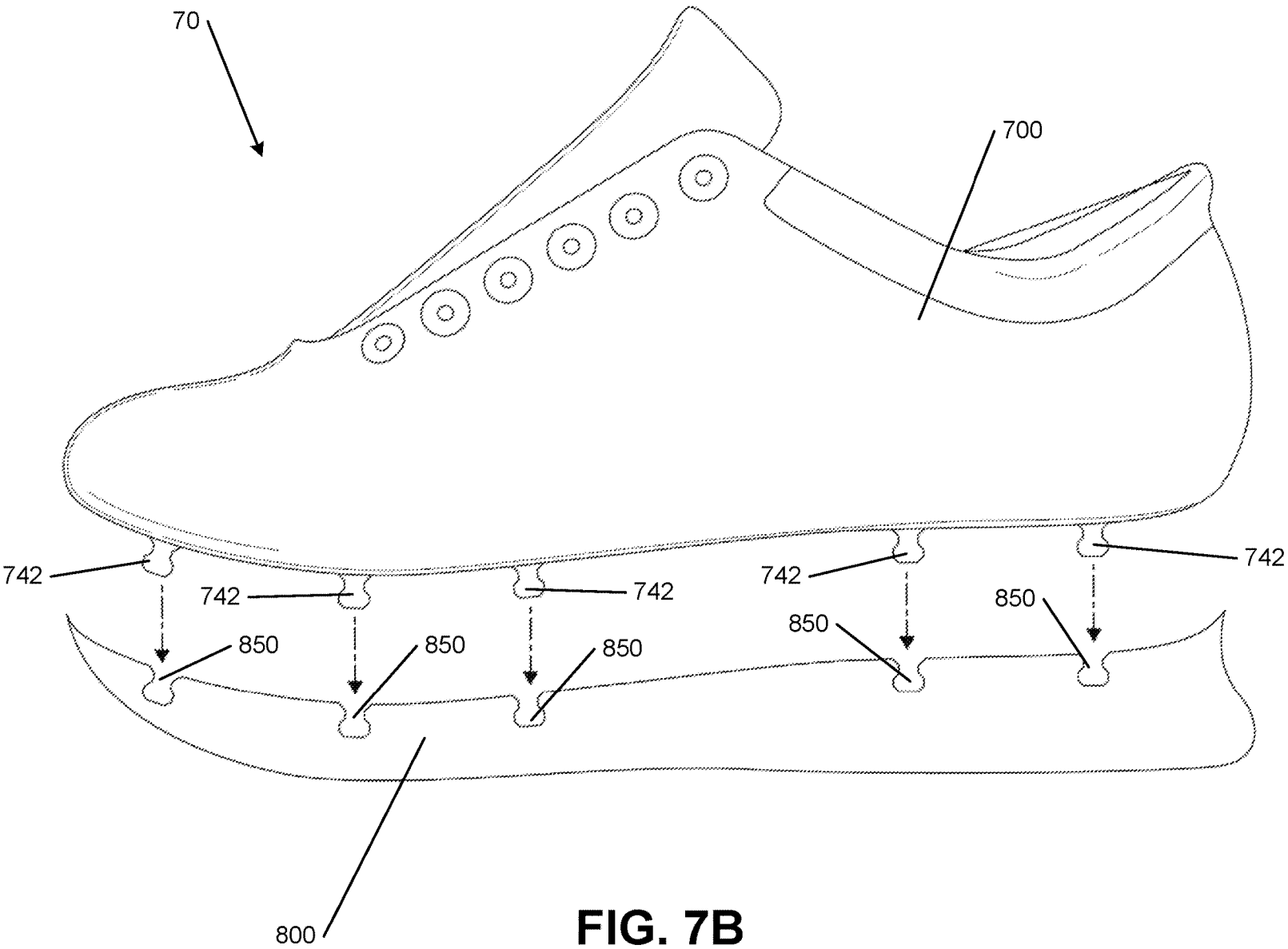
FIG. 7B provides a component view of another article of footwear in accordance with some examples of this technology.
Figure 7C:
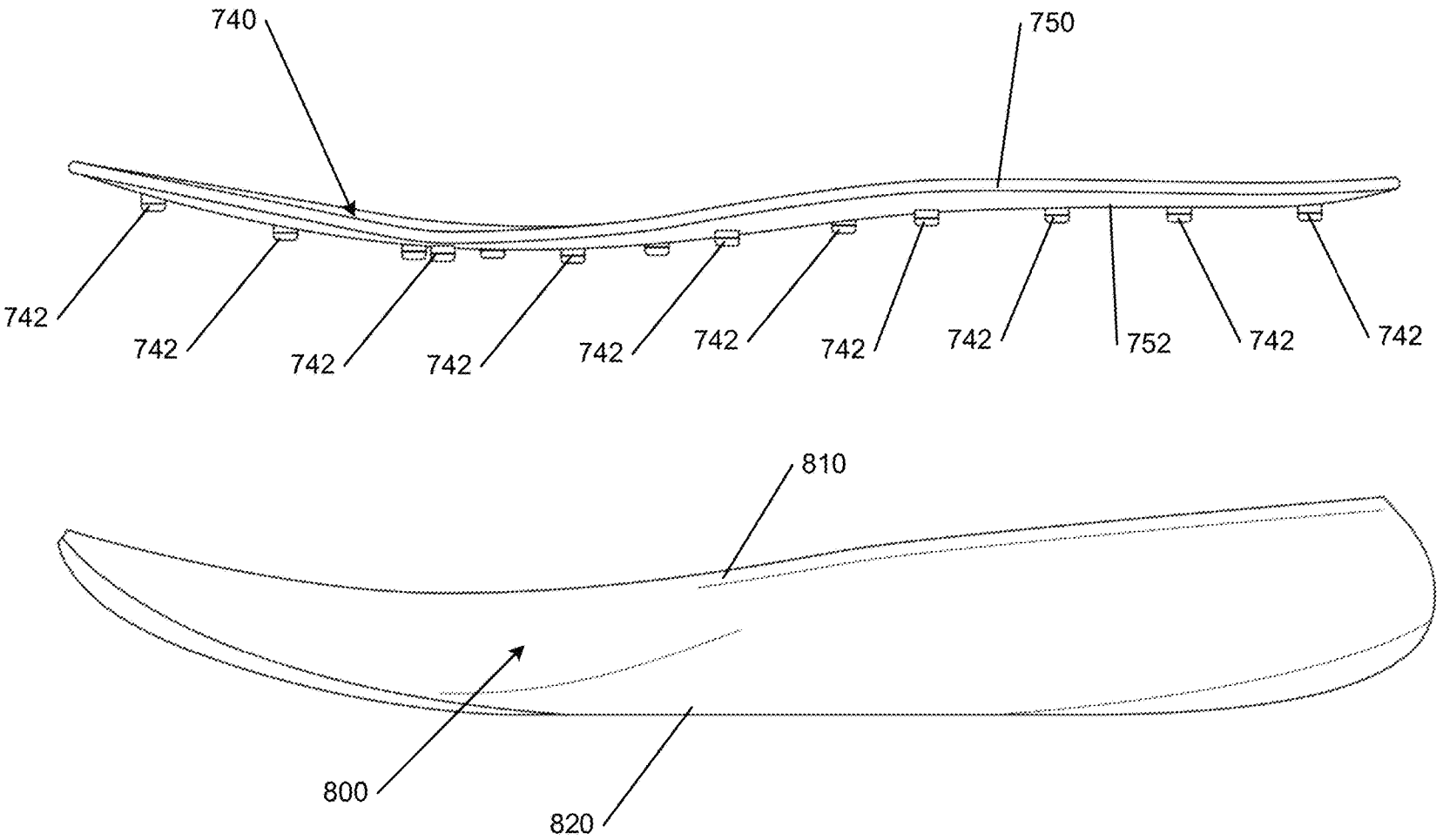
FIG. 7C provides a component view of a strobel structure and a footwear sole structure from an article of footwear in accordance with some examples of this technology.

Referring to the figures and following discussion, examples of footwear component structures and articles of footwear in accordance with aspects of this technology are described. The article of footwear 70 of FIG. 7A may be utilized for example, but not limited to running-type activities, cross-training, track, sprinting, walking, hiking, etc. The article of footwear 70 may include a foot support component 700 and a footwear sole structure 800. Each of the foot support component 700 and the footwear sole structure 800 may be formed as a unitary, one-piece construction and/or each made from a single material. The foot support component 700 may include a strobel 740 or strobel-similar structure as illustrated in FIGS. 7A-7C. The footwear sole structure 800 may attach to the bottom of the foot support component 700 via the strobel 740 and the sole locking inserts 742 as illustrated in FIGS. 7B and 7C. The foot support component 700 may be engaged with the footwear sole structure 800.

Figure 8A:
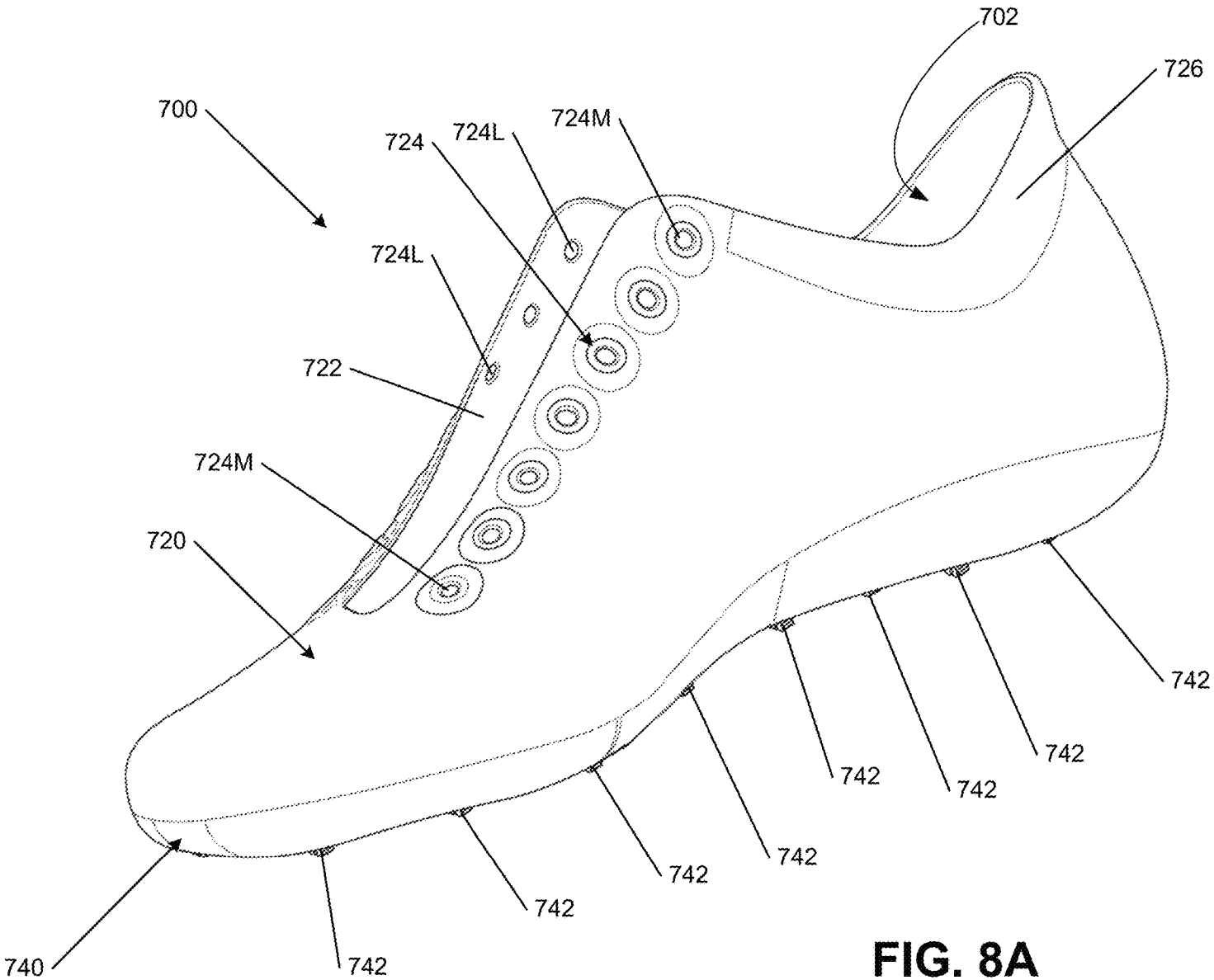
FIGS. 8A-8C provide various views a foot support component of the article of footwear in from FIG. 7A in accordance with some examples of this technology.
Figure 8B:
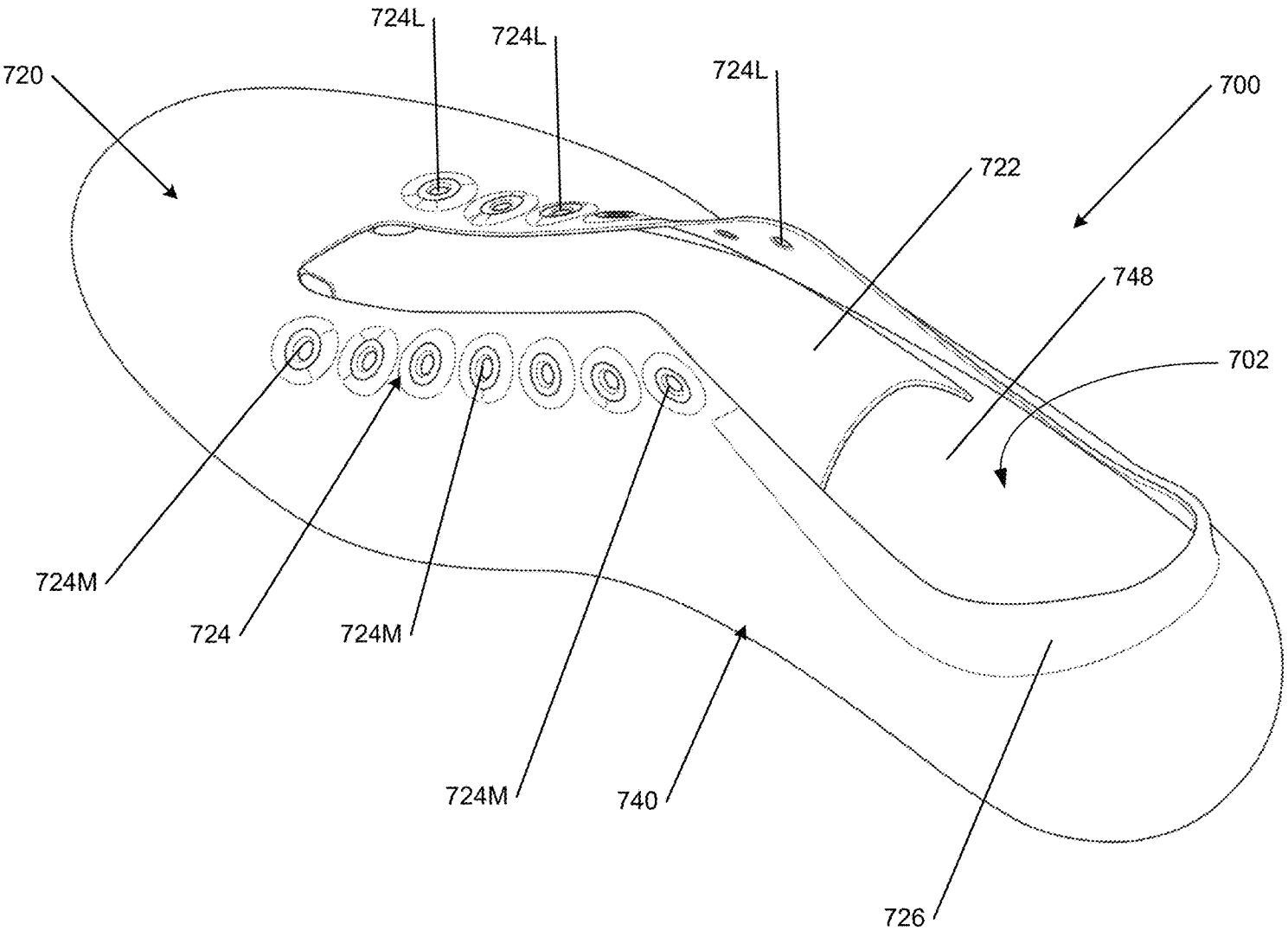
Figure 8C:
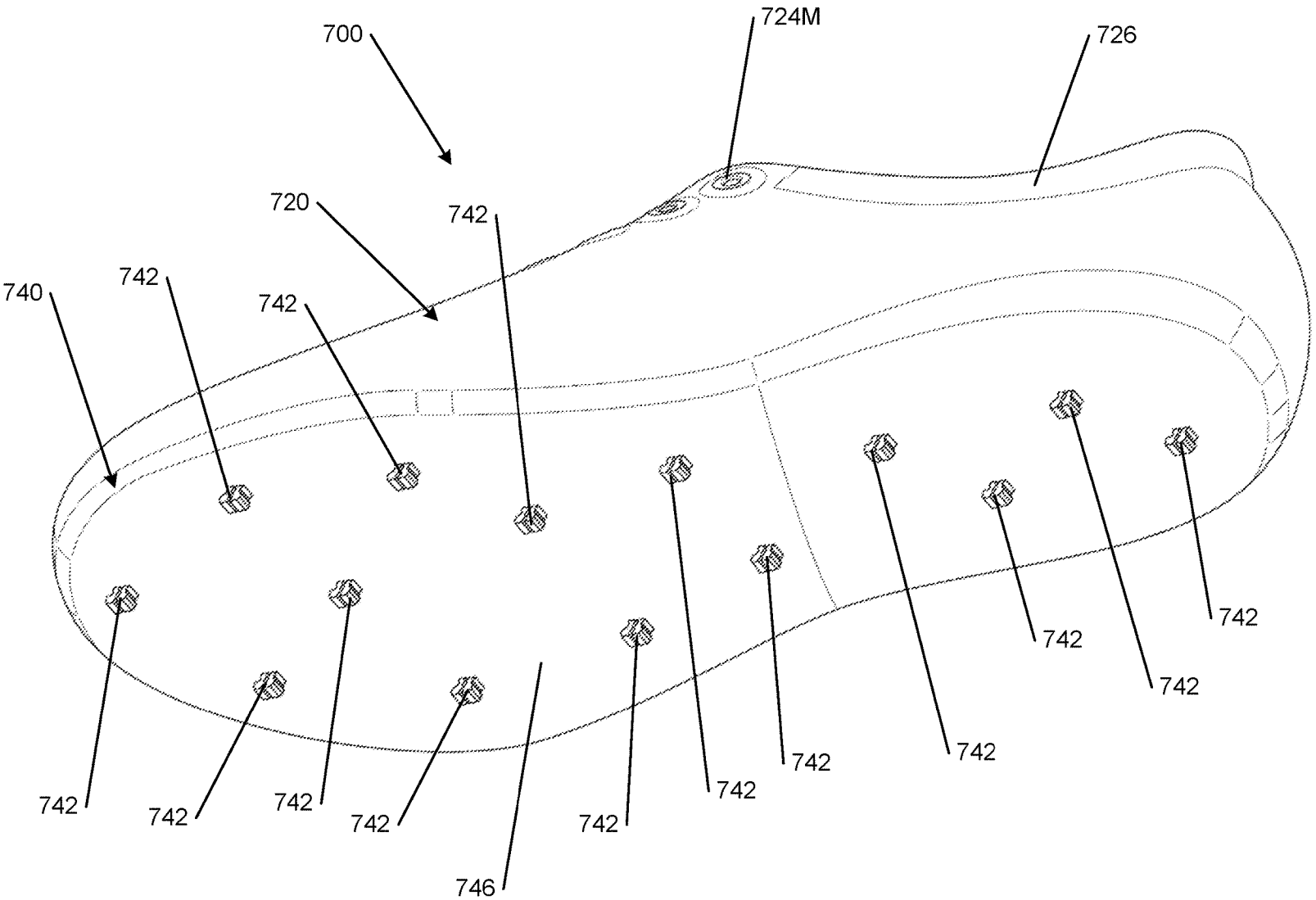
Figure 8D:
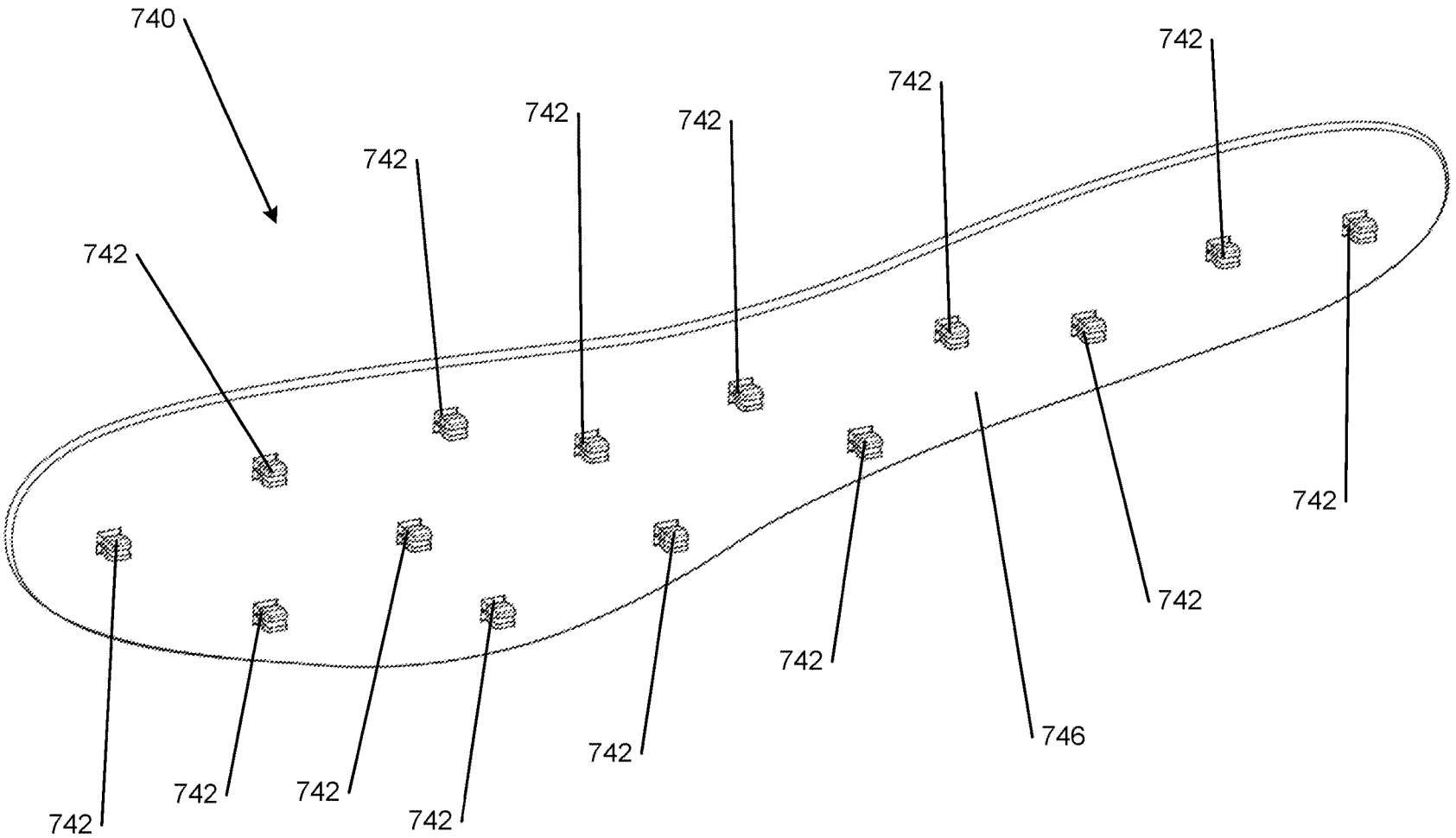
FIG. 8D provides a bottom perspective view of a strobel structure of an article of footwear in accordance with some examples of this technology.

In the figures, FIG. 8A provides a front, medial perspective view; FIG. 8B provides a rear, medial perspective view; and FIG. 8C provides a bottom, medial perspective view of a foot support component 700 of an article of footwear in accordance with some examples of this technology. FIG. 8D provides a bottom, medial perspective view of a strobel 740 from the foot support component 700 of an article of footwear in accordance with some examples of this technology.

The foot support component 700 may include an upper portion 720 and a strobel structure 740 engaged with the upper portion 720. In some examples, the upper portion 720 and the strobel structure 740 may be formed as a single part (as a unitary, one-piece structure). In some examples, the upper portion 720 and the strobel structure 740 may be engaged with the upper portion 720 in various different methods known and used in the art. The upper portion 720 may also be referenced as an "upper." The upper portion 720 (which may be formed from one or more parts), potentially together with the strobel structure 740, defines a foot-receiving interior chamber 702 for containing a wearer's foot. The interior chamber may include a footbed portion 748 formed by an interior surface of the upper portion 720. The footbed portion 748 may extend along the medial and lateral sides from the toe to the heel of the foot support component 700 and the upper portion 720.

The strobel structure 740 as part of the foot support component 700, will be described in more detail in conjunction with FIG. 8D. The strobel structure 740 may include one or more sole locking inserts 742. The one or more sole locking inserts 742 may be configured to fit inside one or more sole cavities 850 on a topside of the footwear sole structure 800. The strobel structure 740 may be formed as a unitary, one-piece construction that includes both a first (top) surface 750 and a second bottom surface 752 opposite the first surface 750.

As further illustrated in FIGS. 8A-8D, the upper portion 720 of the foot support component 700 may include other components engaged with or integrally formed with the upper portion 720. For example, the upper portion 720 may include a tongue member 722 located across the foot instep area and positioned to moderate the feel of the footwear's closure system on the wearer's foot. The upper 720 may also include a heel counter, a toe cap, or securing straps. Additionally, the upper portion 720 may include a closure system (e.g., including one or more of a lace type closure system, a zippered closure system, a buckle type closure system, elastic stretch elements, etc.). The closure system may include, as illustrated, a plurality of lace engaging openings 724. The article of footwear 70 may further include one or more lace elements extending through the lace engaging openings 724. In the illustrated example, a lace element may extend over the tongue member 722 (for example, in a crisscrossed manner), passing through one or more lace engaging openings 724L, 724M located at a lateral side and a medial side of an instep portion of the upper portion 720 (and/or adjacent a lateral side and a medial side of the instep opening). The lace elements may include a tightening mechanism and/or lock mechanism. The lock mechanism may be located at a rear heel area of the upper portion 720. Further, the upper portion 720 may include a collar 726 extending around opening 102.

As illustrated in FIGS. 8A, 8B, and 8D, the strobel structure 740 may include one or more sole locking inserts 742 that fit inside one or more sole cavities 850. The strobel structure 740 may include both a first (top) surface 750 and a second (bottom) surface 752 opposite the first surface 750. The first surface 750 may be utilized for supporting an entire plantar surface of a wearer's foot (or at least some portion thereof). The second surface 752 may include a plurality of flexible sole locking inserts 742.

FIGS. 8C and 8D illustrate the second (bottom) surface 752 and the strobel structure 740 with a plurality of flexible sole locking inserts 742. The flexible sole locking inserts 742 may at least partially align with each of the sole cavities 850 of the footwear sole structure 800. The flexible sole locking inserts 742 may be sized, shaped, and located for one sole locking insert 742 to fit into and extend into one recess 852 of one sole cavity 850 of the footwear sole structure 800. In another embodiment, two or more sole locking inserts 742 may be sized, shaped, and located to fit into and extend into one recess 852 of one sole cavity 850 of the footwear sole structure 800.

As illustrated specifically in FIGS. 8C and 8D, the flexible sole locking inserts 742 may include an enlarged free end 744 extending from a traction element arm 746. The free end 744 may be positioned to engage an undercut portion 854 within the recess 852 of the sole cavity 850 and secure the sole locking insert 742 within the recess 852 of the sole cavity 850. Further, the free end 744 of the example flexible sole locking inserts 742 may have two enlarged traction element components arranged around an intersection of a flex groove or slit (e.g., with one separate sole locking element component provided on each side of the flex groove or slit). Other flexible sole locking element structures and arrangements are possible without departing from this invention. For example, a flexible sole locking insert 742 may include four "fin-type" enlarged traction element components arranged around an intersection of two flex grooves or slits (e.g., with one separate traction element component provided in each quadrant or sector around the flex grooves or slits). In another example, a flexible sole locking insert 742 may include three traction element components arranged around a "capital T-shaped" junction or intersection of two flex grooves (either or both of the flex grooves may have curvature, if desired). As another example, a flexible sole locking insert 742 may include three sole locking element components arranged around a "capital Y-shaped" junction or intersection of three flex grooves, e.g., arranged at any desired angles (one or more of these flex grooves may have curvature, if desired). While other specific shapes and arrangements are possible, traction element components may have shapes similar to the fin-type enlarged traction element components described above (and may have any of the various specific structural features and/or options described above for enlarged traction element components). In another example, a traction element component with more of a T-shaped structure, may have a structure akin to two adjacent traction element components pushed together so that one extended wall or side faces the groove. The illustrated sole locking inserts 742 of this example may have similar structures (albeit potentially with somewhat different sizes and/or shapes). Those skilled in the art will understand that sole locking inserts 742 may have similar structures, features and/or properties. The sole locking inserts 742 may have any desired sizes, shapes, or dimensions in accordance with this technology.

Additionally, the upper portion 720 and/or strobel structure 740 may include a top panel and a heel support provided around the heel area of the foot support component 700. The heel support may provide additional support for the heel area of a wearer's foot (e.g., akin to a heel counter structure). The top panel may include a lateral rim and a medial rim. The lateral rim may extend from the top panel around at least a portion of the perimeter of the lateral side of the foot support component 700. The medial rim may extend from the top panel around at least a portion of the perimeter of the medial side of the foot support component 700. Additionally, the top panel may include a toe rim that extends from the top panel and around at least a portion of the top perimeter of the toe area of the foot support component 700.

In other examples, the heel support for the foot support component 700 may constitute a heel counter structure, e.g., to limit or control movement of the heel. The heel counter structure may be an integrally formed structure with the foot support component 700. The heel counter structure may include a heel counter lateral sidewall, a heel counter medial sidewall, and a heel counter rear sidewall formed between the heel counter lateral sidewall and the heel counter medial sidewall. The heel counter structure may be a full and closed counter structure at the rear heel area. In other embodiments, the heel counter structure may include structures with openings or grooves around the heel area.

The upper portion 720 and the strobel structure 740 of the foot support component 700 may be a one-piece construction. Alternatively, if desired, the upper portion 720 and the strobel structure 740 may be engaged together in any desired manner (such as by one or more of adhesives or cements, stitching or sewing, mechanical connectors, etc.), including in manners conventionally known and used in the footwear arts. This would enable the upper portion 720 and the strobel structure 740 to still be separated, e.g., for recycling, personalization, and/or customization purposes.

The upper portion 720 may be made from any desired material(s) and/or in any desired constructions and/or manners without departing from this technology. As some more specific examples, all or at least a portion of the upper portion 720 (and optionally a majority, substantially all, or even all of the upper portion 720) may be formed as a woven textile component, a knitted textile component, another textile component, a natural leather component, a synthetic leather component, a polymeric component (e.g., a TPU, etc.), a plastic component, etc. The component(s) for upper portion 720 may have structures and/or constructions like those used in footwear products commercially available from NIKE, Inc. of Beaverton, OR and/or other manufacturers, including conventional structures and constructions as are known and used in the art.

Additionally or alternatively, if desired, the upper portion 720 construction may include foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, upper portions 720 and articles of footwear 70 in accordance with this technology may include foot securing and engaging structures of the types used in footwear products commercially available from NIKE, Inc. of Beaverton, Oregon. These types of wrap-around and/or adaptive or dynamic fit structures may at least partially wrap around and securely hold the wearer's foot.

As yet another alternative or additional feature, if desired, upper portions 720 and articles of footwear 70 in accordance with at least some examples of this technology may include fused layers of upper materials, e.g., uppers of the types that include upper materials bonded by hot melt or other adhesive materials, such as in footwear products commercially available from NIKE, Inc. of Beaverton, Oregon. As still additional examples, upper portions of the types described in U.S. Pat. Nos. 7,347,011 and/or 8,429,835 may be used without departing from this technology (each of U.S. Pat. Nos. 7,347,011 and 8,429,835 is entirely incorporated herein by reference).

Figure 9A:
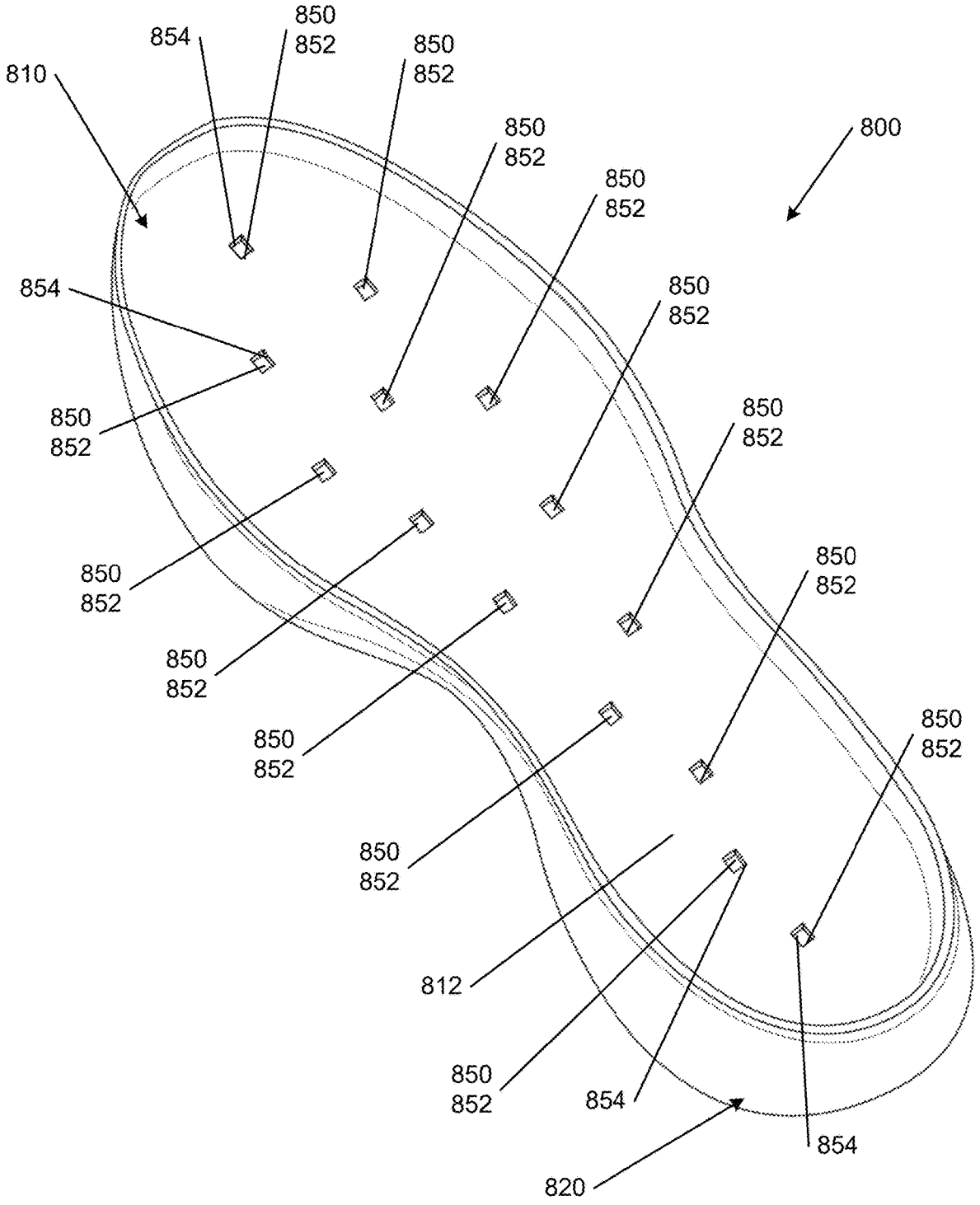
FIGS. 9A, 9B, and 9C provide views of a footwear sole structure of an article of footwear in accordance with some examples of this technology.
Figure 9B:
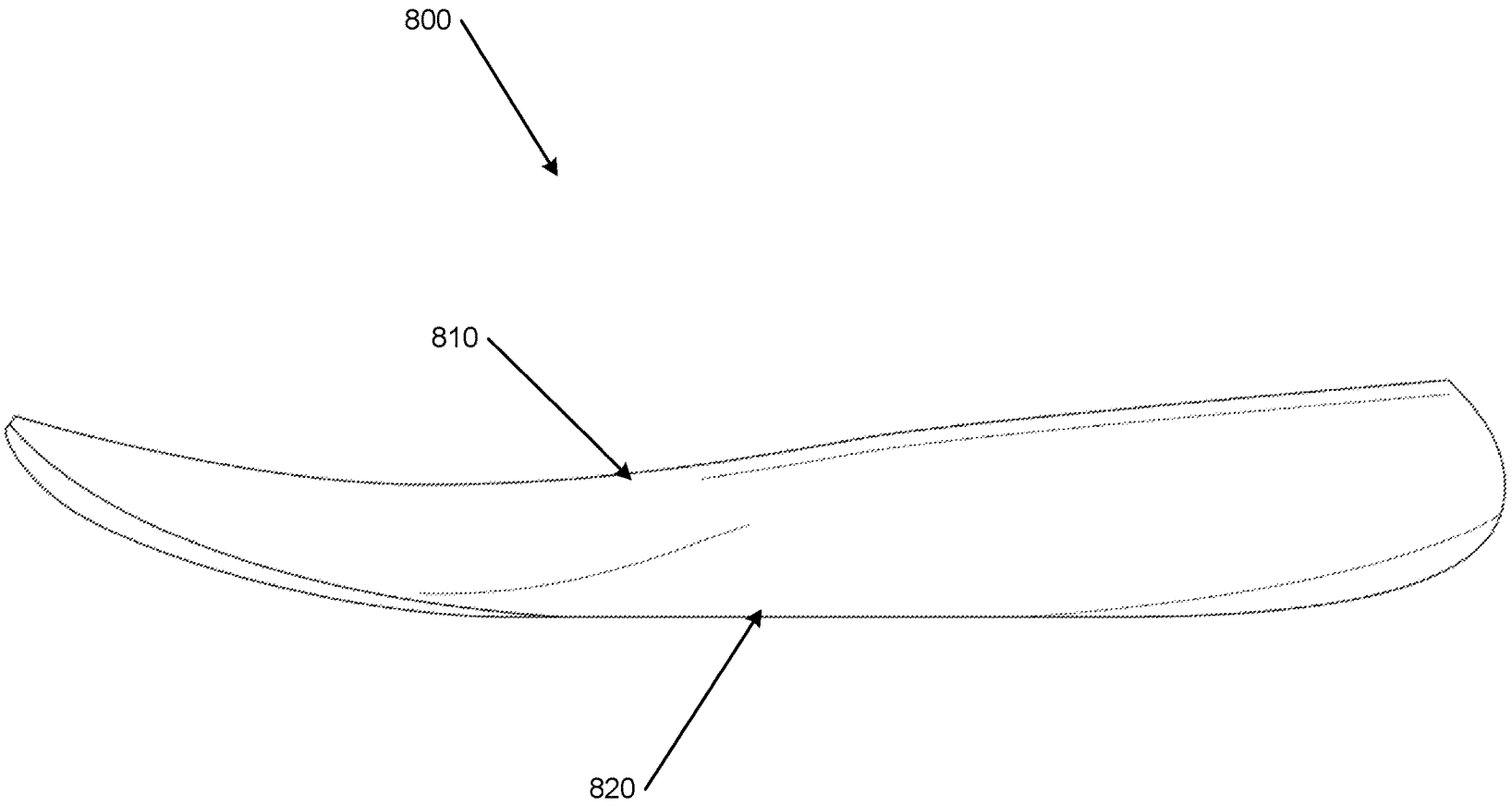
Figure 9C:
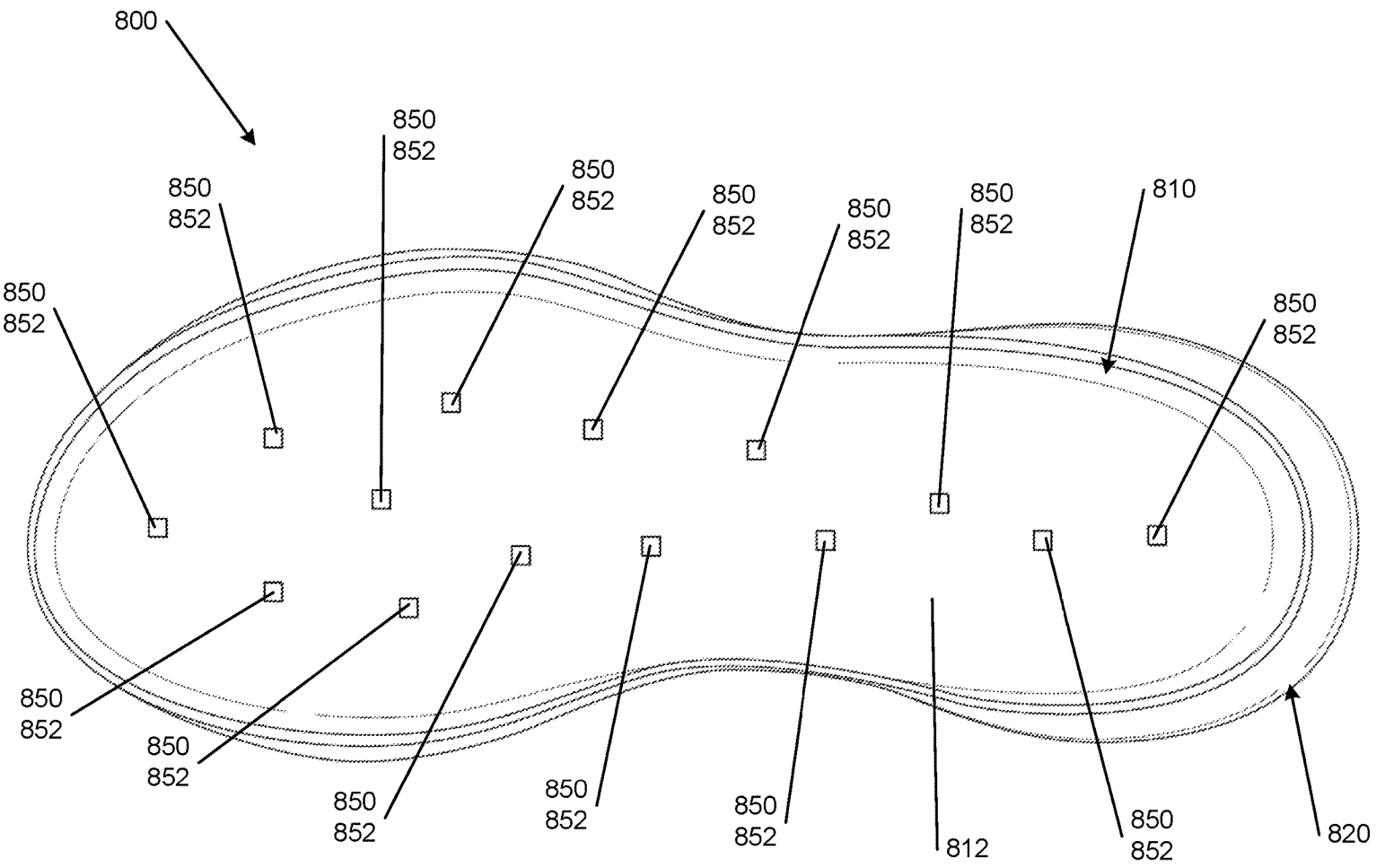

As illustrated in FIGS. 9A-9C, the footwear sole structure 800 may include a midsole component 810 and an outsole component 820. Generally, the midsole component 810 may be located between the outsole component 820 (which contacts the ground) and the strobel structure 740 and the upper portion 720 of the foot support component 700. The midsole component 810 may be designed to give the article of footwear 70 various degrees of cushioning, support, and flexibility. The midsole component 810 may provide added comfort and cushioning for the wearer's foot. The footwear sole structure 800 may include one or more midsole component parts and/or one or more outsole component parts. The footwear sole structure 800 may include a multi-layer, multi-component structure. The footwear sole structure 800 may have conventional constructions and may be made of conventional materials as are known and used in the footwear arts. Further, the footwear sole structure 800 may be engaged with the foot support component 700 components, via the locking of the sole locking insert 742 in the sole cavity 850, and/or including conventional manners as are known and used in the footwear arts.

As illustrated in FIGS. 9A and 9C, the footwear sole structure 800 and the midsole component 810 may include a midsole surface 812. The midsole surface 812 may extend along the medial and lateral sides from the toe to the heel of the footwear sole structure 800. The midsole surface 812 may include one or more sole cavities 850. The sole cavities 850 may be defined by holes in the midsole surface 812 of the footwear sole structure 800. For each sole cavity 850, the midsole surface 812 may also include a recess 852 extending into an interior of the sole cavity 850. The recess 852 may be located around the sole cavity 850 on the midsole surface 812. Further, each sole cavity 850 may include an undercut portion within the interior of the sole cavity 850. The interior surface defined by recess 852 may form a closed end having an enlarged or "bulbous" structure beneath the undercut portion. The undercut portion may provide a "stop surface" within the interior of the sole cavity 850 that engages with and/or cooperates and locks with the sole locking inserts 742 as will be explained and detailed below.

An interior surface of the sole cavity 850 or the recess 852 may define a volume of 1,500 $mm^3$ or less. For example, the volume of interior surface of the sole cavity 850 or the recess 852 may be within a range of approximately 100 $mm^3$ to 1,500 $mm^3$, or in some examples, between 300 $mm^3$ and 1,200 $mm^3$, or between 500 $mm^3$ and 900 $mm^3$.

Additionally, the footwear sole structure 800 and the outsole component 820 may include a ground-contacting surface 822. The ground-contacting surface 822 forms an exterior surface for directly engaging the ground (or other contact surface). The outsole component 820 and the ground-contacting surface 822 may be configured with various traction elements, treads and/or regions having substantially high coefficients of friction with a ground surface.

Figure 10A:
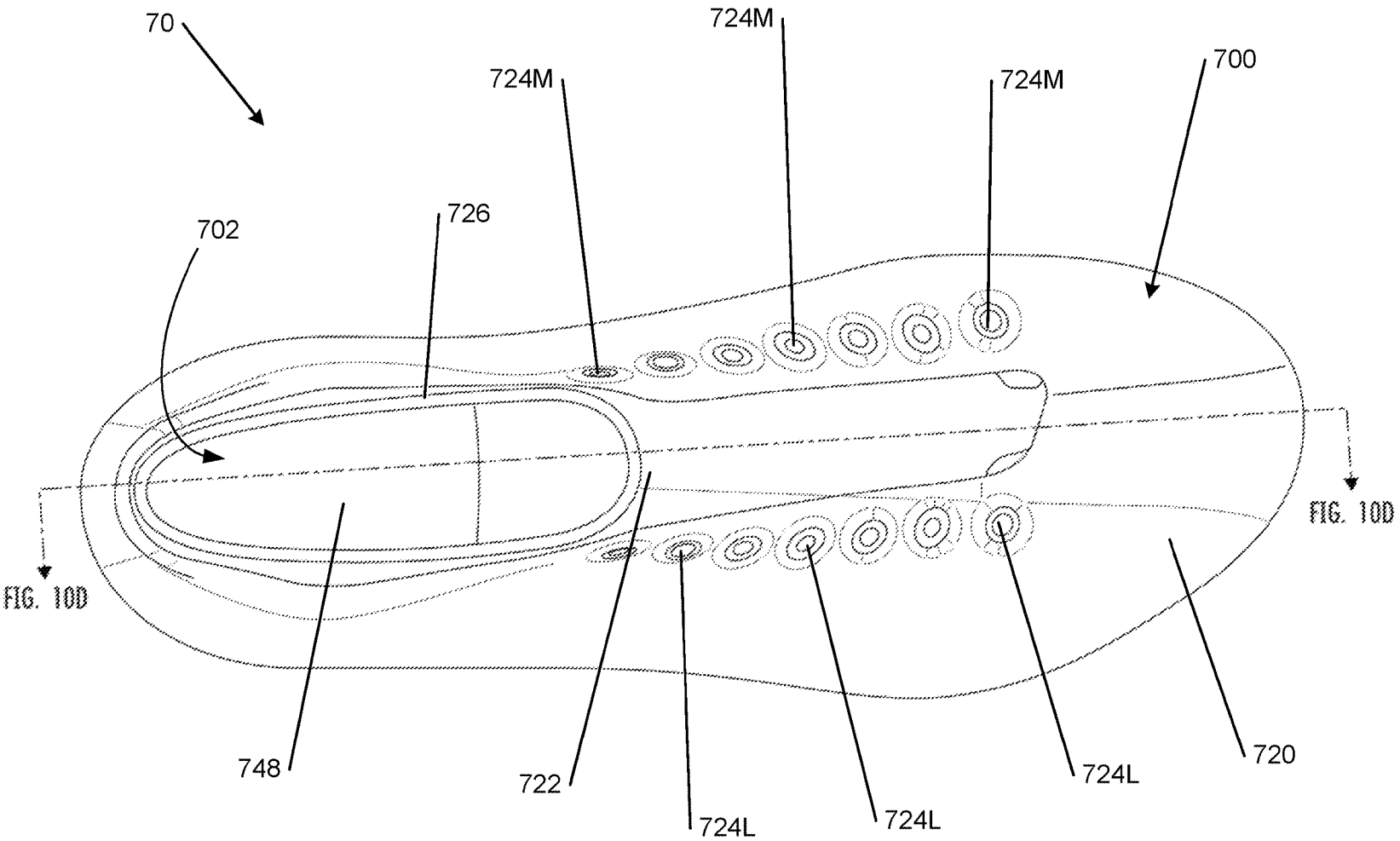
FIG. 10A provides a top view of an article of footwear in accordance with some examples of this technology.
Figure 10B:
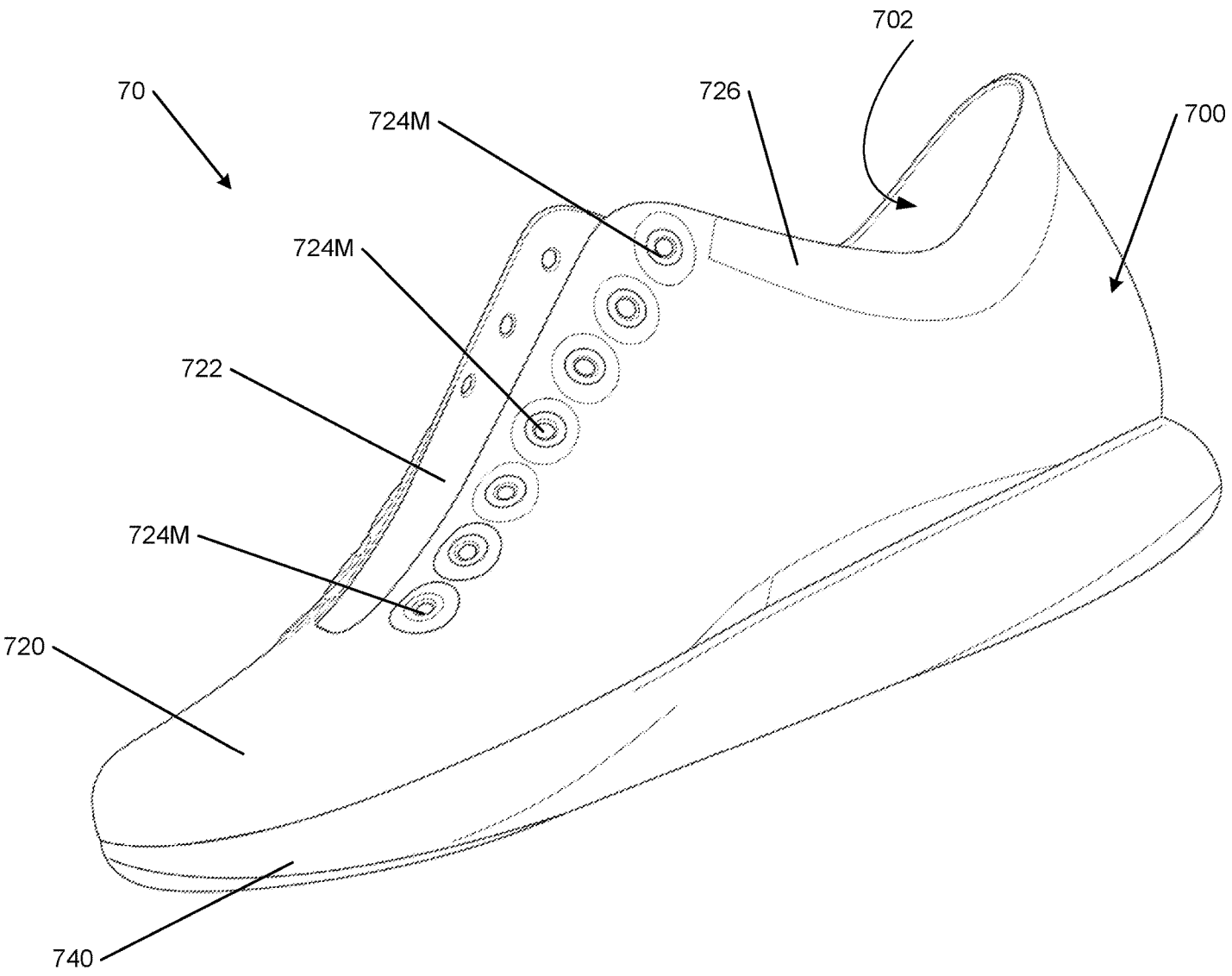
FIGS. 10B and 10C provide various views of the article of footwear from FIG. 10A in accordance with some examples of this technology.
Figure 10C:
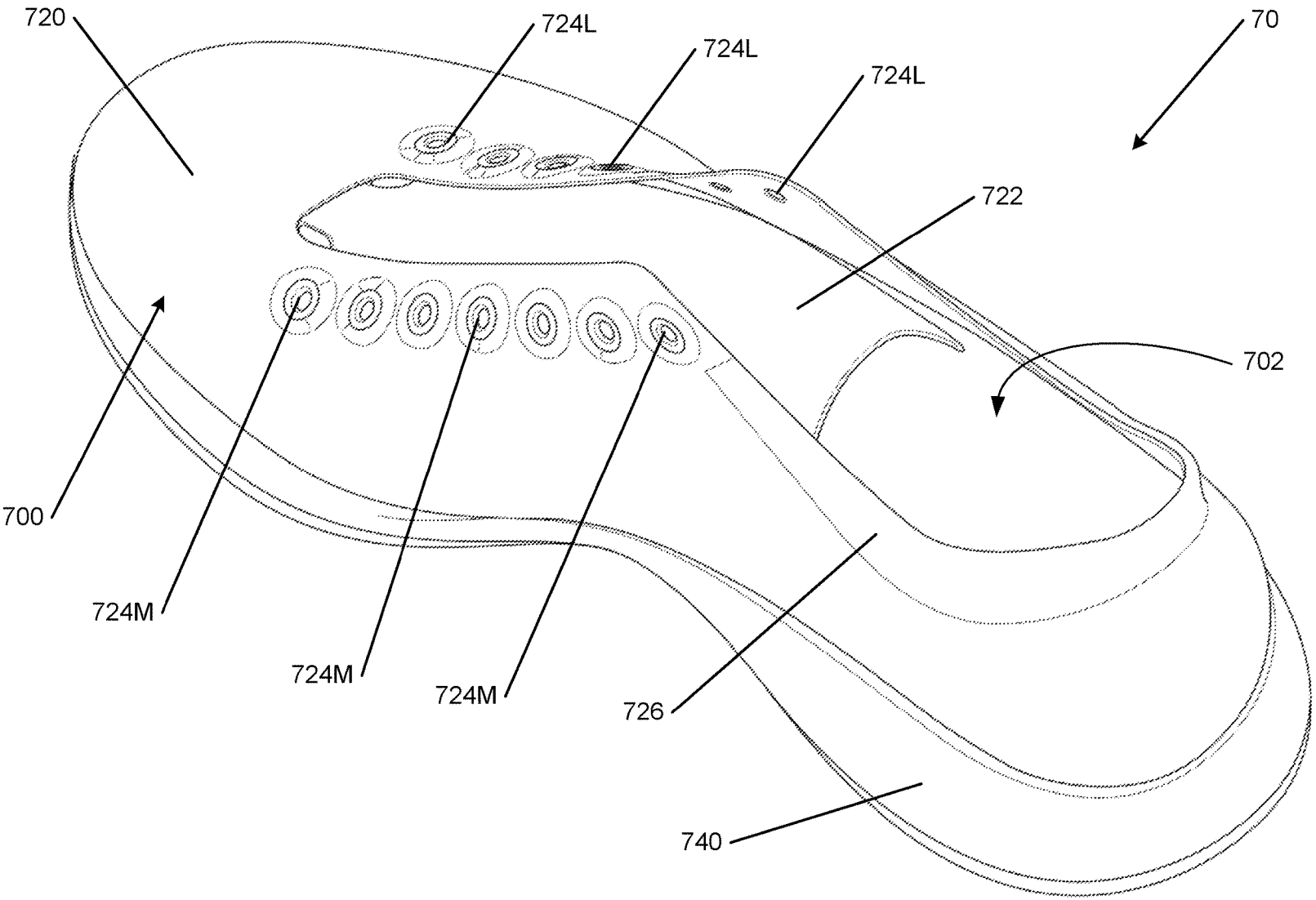
Figure 10D:
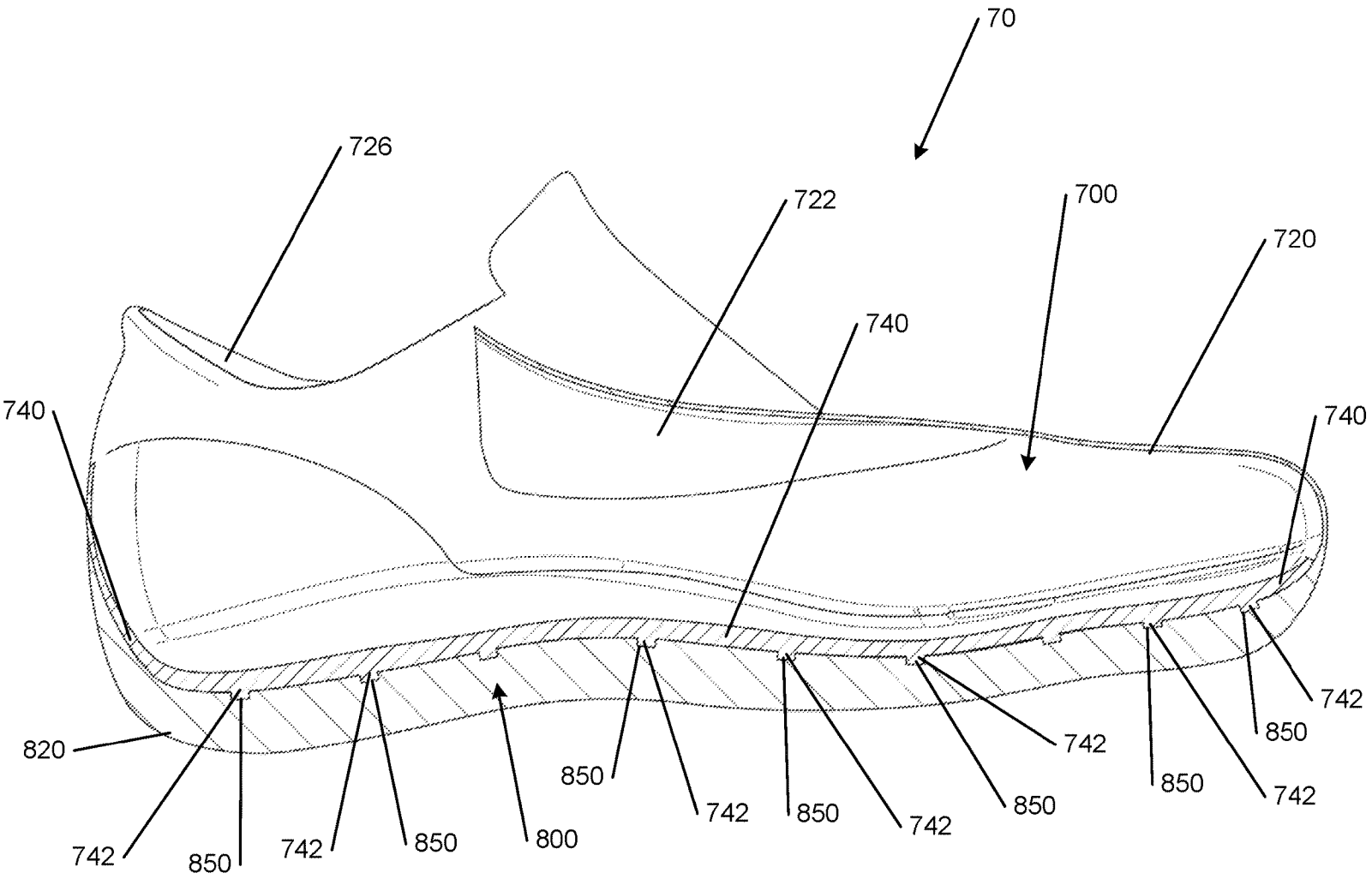
FIG. 10D provides a cross sectional view taken along section line 10D-10D in FIG. 12A of the article of footwear in accordance with some examples of this technology.

Example articles of footwear 70 and components thereof now will be described in more detail in conjunction with FIGS. 10A-10E. FIG. 10A provides a top view; FIG. 10B provides a front, medial perspective view; FIG. 10C provides a rear, medial perspective view; FIG. 10D provides a sectional view along line 10D-10D from FIG. 10A; and FIG. 10E provides a rear perspective cutaway view of the article of footwear 70 highlighting the engagement between the sole locking inserts 742 of the foot support component 700 and the sole cavities 850 of the footwear sole structure 800 in accordance with some examples and aspects of this technology.

FIGS. 10A-10E illustrate an exemplary article of footwear 70 with all of the components together to include the foot support component 700 and the footwear sole structure 800. As illustrated, the foot support component 700 may engage with and lock with the footwear sole structure 800. The foot support component 700 may be oriented so that the sole locking inserts 742 extend into respective recesses 852 of the sole cavities 850. In at least some examples of this technology, a separate insole component, interior midsole component, or other comfort-enhancing component may be provided with the foot support component 700, e.g., to prevent direct contact between the foot support component 700 and the wearer's foot.

Figure 10E:
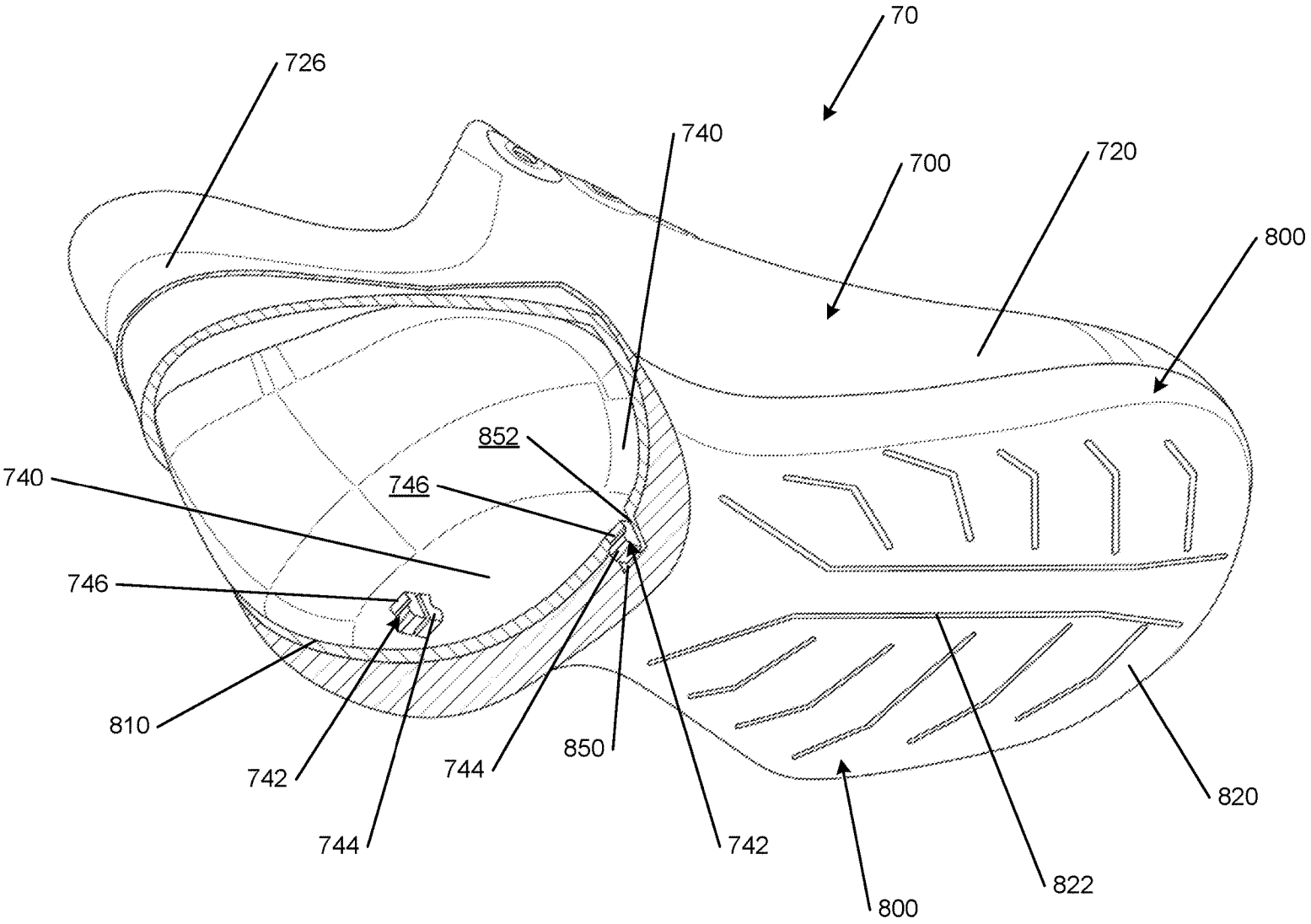
FIG. 10E provides a rear perspective cutaway view of the article of footwear highlighting the engagement between a sole locking insert and a sole cavity in accordance with some examples of this technology.

FIGS. 10D and 10E illustrate the enlarged free end 744 of the sole locking insert 742 of foot support component 700 fitting inside and engaging with the sole cavity 850 and the undercut portion of the sole cavity 850 on the footwear sole structure 800. As illustrated in the above views, the recesses 852 of the sole cavities 850 are formed to include an undercut portion (e.g., the undercut portion providing an opening to a bulbous closed end of the recess 852), and the sole locking inserts 742 include an enlarged end 744 (e.g., a bulbous free end), e.g., formed with enlarged sole locking element components that extend into the recesses 852. The flexible groove or slit in the sole locking insert 742 may narrow with the sole locking element components moving inward towards the flexible groove or slit as the sole locking insert 742 is being pushed past the undercut portion into the recess 852 and toward the closed end of the sole cavity 850. Once the enlarged sole locking element components of the sole locking insert 742 pass beyond the undercut portion, the enlarged sole locking element components of the sole locking insert 742 may resiliently spring back (splay outward) to enlarge the flexible groove or slit and hold the sole locking insert 742 within the sole cavity 850. The bulbous free end 744 of the sole locking insert 742 formed by the enlarged sole locking element components extends into the bulbous closed end of the recess 852 and will contact the undercut portion to prevent the sole locking insert 742 from easily pulling out of the recess 852. The sole locking insert 742 also may provide interior reinforcement or support for the overall traction element construction (e.g., helps prevent the sole cavity 850 from collapsing under applied force to the ground). Other spring elements or biasing components may be provided to help the enlarged sole locking element components (or other retaining structures) spring back to their enlarged spacing to providing this engagement feature.

FIGS. 10D and 10E illustrate the interaction of a sole locking insert 742 and a sole cavity 850 for flexible sole locking element structures and arrangements. The one or more sole locking inserts 742 may interact and fit inside the one or more sole cavities 850 in various different manners. The interaction of the traction element insert 222 and the traction element 142 as illustrated in FIGS. 5A and 5B may be utilized with the one or more sole locking inserts 742 and the one or more sole cavities 850. In another example, the sole locking insert 742 may include an elongated rectangular-shaped sole locking insert with a slit and without a slit that locks with a corresponding elongated rectangular-shaped sole cavity 850. The sole cavity 850 may include a recess 852 with the sole cavity 850 formed to include an undercut portion. The sole locking insert 742 may include an enlarged end 744 that extends into the recess 852. As the sole locking insert 742 is pushed into the recess 852, the enlarged end 744 may push past the undercut portion into the recess 852 to lock and hold the sole locking insert 742 within the recess 852 and the sole cavity 850. For the sole locking insert 742 with a slit, the sole locking insert 742 may resiliently spring back (splay outward) to enlarge, hold, and lock the sole locking insert 742 within the recess 852 and the sole cavity 850. Other shapes of sole locking inserts 742 and sole cavities 850 may be utilized without departing from the invention. Various dimensions may be utilized with the sole locking inserts 742 and sole cavities 850. For example, the sole locking insert 742 may be approximately 2 mm wide by approximately 15 mm tall. The sole locking insert 742 may also be within a range of approximately 1-7 mm wide by approximately 2-15 mm tall without departing from the inventions. For example, an overhang of the enlarged end 744 on the sole locking insert 742 may be approximately 0.5 mm, or within a range of 0.2-0.8 mm. The enlarged end 744 may be approximately 0.8 mm tall, or within a range of 0.5-1.5 mm or a range of 0.2-2.5 mm tall. Other dimensions may be utilized as these dimensions are examples. Based on different stress areas throughout the foot support component 700 and/or the footwear sole structure 800, the one or more sole locking inserts 742 and the one or more sole cavities 850 may be different sizes, shapes, orientations, or arrangements on the foot support component 700.

The foot support component 700 and/or the footwear sole structure 800 may include a rigid plastic material. For example, the rigid plastic material may include one or more (combination) of the following: thermoplastic polyurethane (TPU), polyurethane, nylon, acrylic or polymethyl methacrylate (PMMA), polycarbonate (PC), polyethylene (PE), polypropylene (PP), polyethylene terephthalate (PETE or PET), polyvinyl chloride (PVC), or acrylonitrile-butadiene-styrene (ABS). Other rigid plastic materials may be utilized for the foot support component 700 and/or the footwear sole structure 800. The foot support component 700 and/or the footwear sole structure 800 may be made of other materials similar to and having similar material properties to rigid plastic materials. Various thicknesses and hardness properties may be utilized for the foot support component 700 and/or the footwear sole structure 800.

In at least some examples of this technology, the volume defined by the interior surface of the recess 852 ($V_{RES}$) and the volume defined by the outer surface of the sole locking insert 742 ($V_{INS}$) within the recess 852 when fully inserted into the recess 852 may be substantially equal. As some more specific examples, ratio of $V_{INS}$:$V_{RES}$ may be within a range of 0.75 to 1, and in some examples, from 0.75 to 0.99, 0.75 to 0.95, 0.8 to 1, 0.8 to 0.99, or even 0.8 to 0.95. Additionally or alternatively, in at least some examples of this technology, at least 75% (and in some examples, at least 80%, at least 85%, at least 90%, at least 95%, or even at least 98%) of an exterior surface area of the sole locking insert 742 within the element may directly contact and/or lie immediately adjacent the interior surface of the recess 852. A tight fit with little extra open space within the recess 852 helps prevent undesired "play" or movement of the sole locking inserts 742 within their respective recesses 852.

Further, in at least some examples of this technology, the sole locking inserts 742 extending into their respective recesses 852 (e.g., the engagement of the free ends 744 of sole locking inserts 742 with the undercut surfaces) will be the only connector structures holding the foot support component 700 to the footwear sole structure 800 and/or to the remainder of the footwear structure. Thus, the footwear structure of these examples may be very environmentally friendly and have improved sustainability, e.g., by avoiding use of adhesives.

When one or more of the components' useful life ends, one or more of the components of the article of footwear 70 may be pulled apart, such as by pulling the sole locking inserts 742 out of the sole cavities 850. For example, the foot support component 700 and the sole locking inserts 742 may be pulled away from or out of the footwear sole structure 800 and sole cavities 850. The parts, such as the footwear sole structure 800 and the foot support component 700 may then be easily recycled and replaced.

Various numbers of sole locking inserts 742 may be engaged and correspond with each other for the article of footwear 10. For example, one or more sole locking inserts 742 may correspond and engage with one or more recesses 852 in the sole cavities 850. In another example, two sole locking inserts 742 may correspond and engage with two recesses 852 in the sole cavities 850. In another example, three or more sole locking inserts 742 may correspond and engage with three or more recesses 852 in the sole cavities 850. Any of the sole locking inserts 742 located throughout the foot support component 700, such as along the toe portion, heel portion, or midsection of the foot support component 700, may engage with a corresponding recess 852 in the sole cavity 850 located in the similar location along the footwear sole structure 800, along the toe, heel, or midsection of the footwear sole structure 800.

Example articles of footwear 70 may also include an inner upper component (not shown), and components thereof. The inner upper component may be formed as a unitary, one-piece construction that defines a foot-receiving chamber. The inner upper component may include bottom surface, a heel-containing region, a midfoot-containing region, and a forefoot-containing region. The inner upper component may be formed of a fabric material, such as a knit fabric component (e.g., having a sock-like structure).

This type of removable engagement, when used, is advantageous because it allows individual replacement of parts (e.g., the foot support component 700 and/or the footwear sole structure 800) and/or separation of parts (e.g., the foot support component 700 and/or the footwear sole structure 800) for potential recycling, personalization, and/or customization purposes. Additionally or alternatively, this type of removable engagement, when used, is advantageous because it allows the user to create a customized shoe for the user, e.g., traction, sole shape, sole size, geometry of the shoe, geometry of the user's foot, position of the traction elements, type of the traction elements, and/or size of the traction elements, etc. Additionally or alternatively, this type of removable engagement, when used, is advantageous because it allows the user to swap out the individual parts for other parts, e.g., depending on the activity to be conducted. More specifically, different foot support components 700, footwear sole structures 800, and/or combinations thereof may be used for different activities, e.g., to provide better traction, better support, and/or other desired characteristics for the specific activity. For example, different foot support components 700, footwear sole structures 800, and/or combinations thereof may be used for running on different surfaces, e.g., to provide support and traction for running on cement or a road or to provide support or traction for running on trails or non-cement surfaces. Additionally or alternatively, different foot support components 700, footwear sole structures 800, and/or combinations thereof may be used based on a user's preferences at a specific time (e.g., for different colors and/or color combinations, etc.).

CONCLUSION

The present technology is disclosed above and in the accompanying drawings with reference to a variety of embodiments. The purpose served by the disclosure, however, is to provide an example of the various features and concepts related to the technology, not to limit its scope. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A footwear structure consisting essentially of:

an outer cage component formed as a unitary, one-piece construction that includes: (i) an outsole portion including a plurality of traction elements, and (ii) an upper portion, wherein the outer cage component defines an interior chamber, wherein the interior chamber includes a footbed portion formed by an interior surface of the outsole portion, the footbed portion including a plurality of recesses, wherein each of the plurality of recesses extends into an interior of each of the plurality of traction elements and defines an undercut within the interior of each of the plurality of traction elements; and a foot support component formed as a unitary, one-piece construction that includes: (i) a top surface for supporting an entire plantar surface of a wearer's foot and (ii) a bottom surface opposite the top surface, wherein the bottom surface includes a plurality of traction element inserts, wherein each of the plurality of traction element inserts extends into a respective one of the plurality of recesses, wherein each of the plurality of traction element inserts includes an enlarged free end positioned to engage a respective undercut and secure each of the plurality of traction element inserts within a respective one of the plurality of recesses.

Clause 2. The footwear structure according to Clause 1 further comprising:

an inner upper component formed as a unitary, one-piece construction that defines a foot-receiving chamber including a bottom surface, a heel-containing region, a midfoot-containing region, and a forefoot-containing region, wherein the inner upper component is formed of a fabric material, and wherein the bottom surface includes a plurality of openings, wherein each of the plurality of openings is at least partially aligned with a respective one of the plurality of recesses.

Clause 3. The footwear structure according to Clause 2, wherein the foot support component is received within the foot-receiving chamber of the inner upper component.

Clause 4. The footwear structure according to Clause 2, wherein each of the plurality of traction element inserts extends through a respective one of the plurality of openings.

Clause 5. The footwear structure according to Clause 1, wherein the foot support component includes an integrally formed heel counter.

Clause 6. The footwear structure according to Clause 1, wherein the outer cage component includes lace-engaging openings and the overall footwear structure further including a lace extending thru the lace-engaging openings.

Clause 7. The footwear structure according to Clause 1, wherein each of the traction element inserts includes one or more slits.

Clause 8. The footwear structure according to Clause 1, wherein each of the plurality of free ends includes two enlarged traction element components.

Clause 9. The footwear structure according to Clause 1, wherein each of the plurality of free ends includes three enlarged traction element components.

Clause 10. The footwear structure according to Clause 1, wherein each of the plurality of free ends includes four enlarged traction element components.

Clause 11. The footwear structure according to Clause 1, wherein the traction element inserts engaging their corresponding traction elements form the only means of fastening the shoe component parts together.

Clause 12. The footwear structure according to Clause 1, wherein an exterior surface of each of the plurality of traction elements defines a volume of 2,000 $mm^3$ or less.

Clause 13. The footwear structure according to Clause 1, wherein an exterior surface of each of the plurality of traction elements defines a volume within the range of 250 $mm^3$ to 2,000 $mm^3$.

Clause 14. The footwear structure according to Clause 1, wherein an exterior surface of each of the plurality of traction elements defines a volume within the range of 500 $mm^3$ and 1,750 $mm^3$.

Clause 15. The footwear structure according to Clause 1, wherein an exterior surface of each of the plurality of traction elements defines a volume within the range of 750 $mm^3$ and 1,000 $mm^3$.

Clause 16. The footwear structure according to Clause 1, wherein an interior surface of each of the plurality of recesses defines a volume of 1,500 $mm^3$ or less.

Clause 17. The footwear structure according to Clause 1, wherein an interior surface of each of the plurality of recesses defines a volume between 300 $mm^3$ to 1,500 $mm^3$.

Clause 18. The footwear structure according to Clause 1, wherein an interior surface of each of the plurality of recesses defines a volume between 400 $mm^3$ and 1,000 $mm^3$.

Clause 19. The footwear structure according to Clause 1, wherein an interior surface of each of the plurality of recesses defines a volume between 450 $mm^3$ and 900 $mm^3$.

Clause 20. The footwear structure according to Clause 1, wherein a volume ratio of an interior surface of each of the plurality of recesses to an exterior surface of each of the plurality of traction elements is within the range of 0.3 to 0.7.

Clause 21. The footwear structure according to Clause 1, wherein the volume ratio is within the range of 0.35 to 0.65.

Clause 22. The footwear structure according to Clause 1, wherein the volume ratio is within the range of 0.4 to 0.6.

Clause 23. A footwear structure comprising:

an outer cage component formed as a unitary, one-piece construction that includes: (i) an outsole portion including a plurality of traction elements, and (ii) an upper portion, wherein the outer cage component defines an interior chamber, wherein the interior chamber includes a footbed portion formed by an interior surface of the outsole portion, the footbed portion including a plurality of recesses, wherein each of the plurality of recesses extends into an interior of each of the plurality of traction elements and defines an undercut within the interior of each of the plurality of traction elements; and a foot support component formed as a unitary, one-piece construction that includes: (i) a top surface for supporting an entire plantar surface of a wearer's foot and (ii) a bottom surface opposite the top surface, wherein the bottom surface includes a plurality of traction element inserts, wherein each of the plurality of traction element inserts extends into a respective one of the plurality of recesses, wherein each of the plurality of traction element inserts includes an enlarged free end positioned to engage a respective undercut and secure each of the plurality of traction element inserts within a respective one of the plurality of recesses.

Clause 24. The footwear structure according to Clause 23 further comprising:

an inner upper component formed as a unitary, one-piece construction that defines a foot-receiving chamber including a bottom surface, a heel-containing region, a midfoot-containing region, and a forefoot-containing region, wherein the inner upper component is formed of a fabric material, and wherein the bottom surface includes a plurality of openings, wherein each of the plurality of openings is at least partially aligned with a respective one of the plurality of recesses.

Clause 25. The footwear structure according to Clause 24, wherein the foot support component is received within the foot-receiving chamber of the inner upper component.

Clause 26. The footwear structure according to Clause 24, wherein each of the plurality of traction element inserts extends through a respective one of the plurality of openings.

Clause 27. The footwear structure according to Clause 23, wherein the foot support component includes an integrally formed heel counter.

Clause 28. The footwear structure according to Clause 23, wherein the outer cage component includes lace-engaging openings and the overall footwear structure further including a lace extending thru the lace-engaging openings.

Clause 29. The footwear structure according to Clause 23, wherein each of the traction element inserts includes one or more slits.

Clause 30. The footwear structure according to Clause 23, wherein each of the plurality of free ends includes two enlarged traction element components.

Clause 31. The footwear structure according to Clause 23, wherein each of the plurality of free ends includes three enlarged traction element components.

Clause 32. The footwear structure according to Clause 23, wherein each of the plurality of free ends includes four enlarged traction element components.

Clause 33. The footwear structure according to Clause 23, wherein the traction element inserts engaging their corresponding traction elements form the only means of fastening the shoe component parts together.

Clause 34. The footwear structure according to Clause 23, wherein an exterior surface of each of the plurality of traction elements defines a volume of 2,000 $mm^3$ or less.

Clause 35. The footwear structure according to Clause 23, wherein an exterior surface of each of the plurality of traction elements defines a volume within the range of 250 $mm^3$ to 2,000 $mm^3$.

Clause 36. The footwear structure according to Clause 23, wherein an exterior surface of each of the plurality of traction elements defines a volume within the range of 500 $mm^3$ and 1,750 $mm^3$.

Clause 37. The footwear structure according to Clause 23, wherein an exterior surface of each of the plurality of traction elements defines a volume within the range of 750 $mm^3$ and 1,000 $mm^3$.

Clause 38. The footwear structure according to Clause 23, wherein an interior surface of each of the plurality of recesses defines a volume of 1,500 $mm^3$ or less.

Clause 39. The footwear structure according to Clause 23, wherein an interior surface of each of the plurality of recesses defines a volume between 300 $mm^3$ to 1,500 $mm^3$.

Clause 40. The footwear structure according to Clause 23, wherein an interior surface of each of the plurality of recesses defines a volume between 400 $mm^3$ and 1,000 $mm^3$.

Clause 41. The footwear structure according to Clause 23, wherein an interior surface of each of the plurality of recesses defines a volume between 450 $mm^3$ and 900 $mm^3$.

Clause 42. The footwear structure according to Clause 23, wherein a volume ratio of an interior surface of each of the plurality of recesses to an exterior surface of each of the plurality of traction elements is within the range of 0.3 to 0.7.

Clause 43. The footwear structure according to Clause 42, wherein the volume ratio is within the range of 0.35 to 0.65.

Clause 44. The footwear structure according to Clause 43, wherein the volume ratio is within the range of 0.4 to 0.6.

Clause 45. A footwear structure consisting essentially of:

a foot support component formed as a unitary, one-piece construction that includes: (i) an upper portion that defines an interior chamber, wherein the interior chamber includes a footbed portion formed by an interior surface of the upper portion, and (ii) a strobel structure attached to the upper portion that includes a top surface for supporting an entire plantar surface of a wearer's foot and a bottom surface opposite the top surface, wherein the bottom surface includes a plurality of sole locking inserts; and a sole structure component formed as a unitary, one-piece construction that includes: (i) an outsole component that includes a ground-contacting surface for directly engaging the ground, and (ii) a midsole component located between the outsole component and the strobel structure, the midsole component including a midsole surface including a plurality of sole cavities, wherein each of the plurality of sole cavities includes a recess extending into an interior of the sole cavity and defines an undercut within the interior of each of the plurality of sole cavities, wherein each of the plurality of sole locking inserts extends into a respective one of the plurality of recesses, wherein each of the plurality of sole locking inserts includes an enlarged free end positioned to engage a respective undercut and secure each of the plurality of sole locking inserts within a respective one of the plurality of recesses.

Clause 46. The footwear structure according to Clause 45, wherein the foot support component includes an integrally formed heel counter.

Clause 47. The footwear structure according to Clause 45, wherein the upper portion includes lace-engaging openings and the overall footwear structure further including a lace extending thru the lace-engaging openings.

Clause 48. The footwear structure according to Clause 45, wherein each of the sole locking inserts includes one or more slits.

Clause 49. The footwear structure according to Clause 45, wherein each of the plurality of free ends includes two enlarged sole locking insert components.

Clause 50. The footwear structure according to Clause 45, wherein each of the plurality of free ends includes three enlarged sole locking insert components.

Clause 51. The footwear structure according to Clause 45, wherein each of the plurality of free ends includes four enlarged sole locking insert components.

Clause 52. The footwear structure according to Clause 45, wherein the sole locking inserts engaging their corresponding sole cavities form the only means of fastening the shoe component parts together.

Clause 53. The footwear structure according to Clause 45, wherein an interior surface of each of the plurality of recesses defines a volume of 1,500 $mm^3$ or less.

Clause 54. The footwear structure according to Clause 45, wherein an interior surface of each of the plurality of recesses defines a volume between 100 $mm^3$ to 1,500 $mm^3$.

Clause 55. The footwear structure according to Clause 45, wherein an interior surface of each of the plurality of recesses defines a volume between 300 $mm^3$ and 1,200 $mm^3$.

Clause 56. The footwear structure according to Clause 45, wherein an interior surface of each of the plurality of recesses defines a volume between 500 $mm^3$ and 900 $mm^3$.

Clause 57. The footwear structure according to Clause 45, wherein a volume ratio of an interior surface of each of the plurality of recesses to an outer surface of each of the plurality of sole locking inserts is within the range of 0.75 to 1.0.

Clause 58. The footwear structure according to Clause 57, wherein the volume ratio is within the range of 0.75 to 0.99.

Clause 59. The footwear structure according to Clause 58, wherein: wherein the volume ratio is within the range of 0.8 to 0.95.

Clause 60. A footwear structure comprising:

a foot support component formed as a unitary, one-piece construction that includes: (i) an upper portion that defines an interior chamber, wherein the interior chamber includes a footbed portion formed by an interior surface of the upper portion, and (ii) a strobel structure attached to the upper portion that includes a top surface for supporting an entire plantar surface of a wearer's foot and a bottom surface opposite the top surface, wherein the bottom surface includes a plurality of sole locking inserts; and a sole structure component formed as a unitary, one-piece construction that includes: (i) an outsole component that includes a ground-contacting surface for directly engaging the ground, and (ii) a midsole component located between the outsole component and the strobel structure, the midsole component including a midsole surface including a plurality of sole cavities, wherein each of the plurality of sole cavities includes a recess extending into an interior of the sole cavity and defines an undercut within the interior of each of the plurality of sole cavities, wherein each of the plurality of sole locking inserts extends into a respective one of the plurality of recesses, wherein each of the plurality of sole locking inserts includes an enlarged free end positioned to engage a respective undercut and secure each of the plurality of sole locking inserts within a respective one of the plurality of recesses.

Clause 61. The footwear structure according to Clause 60, wherein the foot support component includes an integrally formed heel counter.

Clause 62. The footwear structure according to Clause 60, wherein the upper portion includes lace-engaging openings and the overall footwear structure further including a lace extending thru the lace-engaging openings.

Clause 63. The footwear structure according to Clause 60, wherein each of the sole locking inserts includes one or more slits.

Clause 64. The footwear structure according to Clause 60, wherein each of the plurality of free ends includes two enlarged sole locking insert components.

Clause 65. The footwear structure according to Clause 60, wherein each of the plurality of free ends includes three enlarged sole locking insert components.

Clause 66. The footwear structure according to Clause 60, wherein each of the plurality of free ends includes four enlarged sole locking insert components.

Clause 67. The footwear structure according to Clause 60, wherein the sole locking inserts engaging their corresponding sole cavities form the only means of fastening the shoe component parts together.

Clause 68. The footwear structure according to Clause 60, wherein an interior surface of each of the plurality of recesses defines a volume of 1,500 $mm^3$ or less.

Clause 69. The footwear structure according to Clause 60, wherein an interior surface of each of the plurality of recesses defines a volume between 100 $mm^3$ to 1,500 $mm^3$.

Clause 70. The footwear structure according to Clause 60, wherein an interior surface of each of the plurality of recesses defines a volume between 300 $mm^3$ and 1,200 $mm^3$.

Clause 71. The footwear structure according to Clause 60, wherein an interior surface of each of the plurality of recesses defines a volume between 500 $mm^3$ and 900 $mm^3$.

Clause 72. The footwear structure according to Clause 60, wherein a volume ratio of an interior surface of each of the plurality of recesses to an outer surface of each of the plurality of sole locking inserts is within the range of 0.75 to 1.0.

Clause 73. The footwear structure according to Clause 72, wherein the volume ratio is within the range of 0.75 to 0.99.

Clause 74. The footwear structure according to Clause 73, wherein the volume ratio is within the range of 0.8 to 0.95.

What is claimed is:

1. A three-piece footwear structure comprising:

an outer cage component formed as a unitary, one-piece construction that includes: (i) an outsole portion including a plurality of traction elements, and (ii) an upper portion, wherein the outer cage component defines an interior chamber, wherein the interior chamber includes a footbed portion formed by an interior surface of the outsole portion, the footbed portion including a plurality of recesses, wherein each of the plurality of recesses extends into an interior of each of the plurality of traction elements and defines an undercut within the interior of each of the plurality of traction elements;

a foot support component which fits inside of the outer cage component and is formed as a unitary, one-piece construction that includes: (i) a top surface for supporting an entire plantar surface of a wearer's foot and (ii) a bottom surface opposite the top surface, wherein the bottom surface includes a plurality of traction element inserts, wherein each of the plurality of traction element inserts extends into a respective one of the plurality of recesses, wherein each of the plurality of traction element inserts includes an enlarged free end positioned to engage a respective undercut and secure each of the plurality of traction element inserts within a respective one of the plurality of recesses;

an inner upper component which fits inside of the outer cage component and is formed as a unitary, one-piece construction that defines a foot-receiving chamber including a bottom surface, a heel-containing region, a midfoot-containing region, and a forefoot-containing region, wherein the inner upper component is formed of a knit-fabric material; and wherein the bottom surface of the inner upper component includes a plurality of openings, wherein each of the plurality of openings is at least partially aligned with a respective one of the plurality of recesses.

2. The three-piece footwear structure according to claim 1, wherein the foot support component is received within the foot-receiving chamber of the inner upper component.

3. The three-piece footwear structure according to claim 1, wherein each of the plurality of traction element inserts extends through a respective one of the plurality of openings.

4. The three-piece footwear structure according to claim 1, wherein the foot support component includes an integrally formed heel counter.

5. The three-piece footwear structure according to claim 1, wherein the outer cage component includes lace-engaging openings configured to receive a lace extending through the lace-engaging openings.

6. The three-piece footwear structure according to claim 1, wherein each of the traction element inserts includes one or more slits.

7. The three-piece footwear structure according to claim 1, wherein each of the plurality of free ends includes two enlarged traction element components.

8. The three-piece footwear structure according to claim 1, wherein an exterior surface of each of the plurality of traction elements defines a volume of 2,000 $mm^3$ or less.

9. The three-piece footwear structure according to claim 1, wherein an interior surface of each of the plurality of recesses defines a volume of 1,500 $mm^3$ or less.

10. The three-piece footwear structure according to claim 1, wherein a volume ratio of an interior surface of each of the plurality of recesses to an exterior surface of each of the plurality of traction elements is within the range of 0.3 to 0.7.

* * * * *